US005245324A

United States Patent [19]

Jonker et al.

[11] Patent Number: 5,245,324

[45] Date of Patent: Sep. 14, 1993

[54] DIGITAL ENGINE ANALYZER

[75] Inventors: Gary D. Jonker, Kenosha, Wis.; Craig F. Govekar, Gurnee, Ill.; Michael B. Meeker, Kenosha, Wis.; James R. Piehl, Kenosha, Wis.; Michael C. Putrow, Racine, Wis.; John C. Sniegowski, Kenosha, Wis.

[73] Assignee: Snap-on Tools Corporation, Kenosha, Wis.

[21] Appl. No.: 779,509

[22] Filed: Oct. 18, 1991

Related U.S. Application Data

[62] Division of Ser. No. 587,357, Sep. 24, 1990.

[51] Int. Cl.[5] ..... G09G 5/00

[52] U.S. Cl. ..... 345/134; 324/379; 324/121 R; 364/431.04; 345/11; 345/69

[58] Field of Search ..... 340/706, 711, 712, 720, 340/721, 722, 723, 747; 341/22; 324/379, 384, 394, 121 R; 364/480, 481, 487, 483, 431.01, 431.03, 431.04; 73/117.2, 117.3; 358/194.1, 210

[56] References Cited

U.S. PATENT DOCUMENTS

| | | | |
|---|---|---|---|
| 4,125,894 | 11/1978 | Cashel et al. | 324/384 |
| 4,310,839 | 1/1982 | Schwerdt | 340/712 |
| 4,318,130 | 3/1982 | Heuer | 358/194.1 |
| 4,633,514 | 12/1986 | Fimoff et al. | 358/194.1 |
| 4,743,968 | 5/1988 | Mogi et al. | 358/194.1 |
| 4,858,006 | 8/1989 | Suzuki et al. | 358/194.1 |

*Primary Examiner*—Richard Hjerpe
*Attorney, Agent, or Firm*—Emrich & Dithmar

[57] ABSTRACT

A digital engine analyzer has an oscilloscope display and is controlled by microprocessors operating under menu-driven stored program control. The analyzer receives analog input signals from an engine being analyzed. The analyzer is provided with a scanner interface, so that a scanner designed to read data from a vehicle on-board computer, can transfer this data to the analyzer for display on the analyzer oscilloscope. The analyzer processor, when operating in the scanner interface mode, operates under stored program control to reconfigure analyzer keyboard and soft key functions to duplicate scanner control functions, so that the scanner control functions can be effected from the analyzer.

9 Claims, 22 Drawing Sheets

55

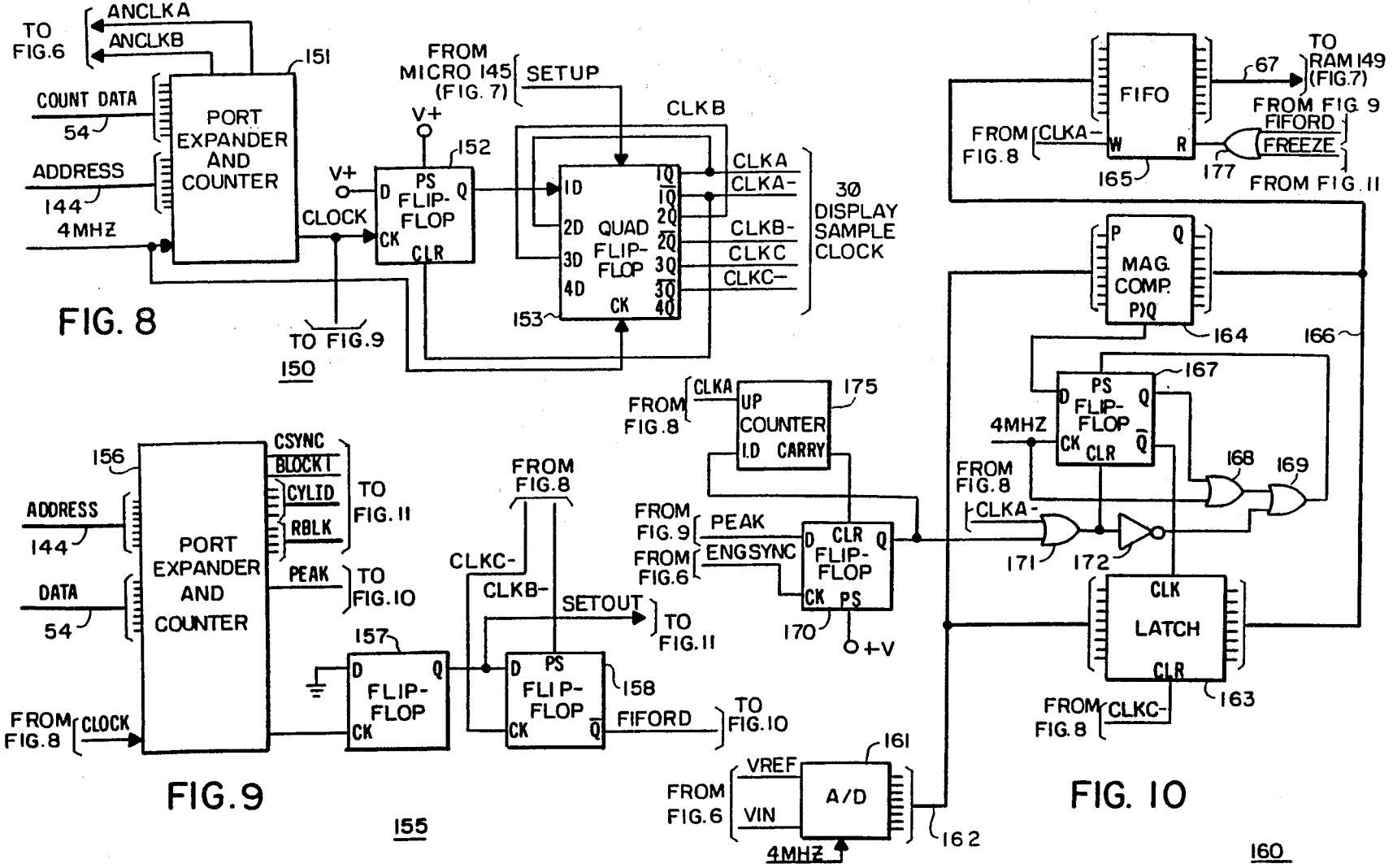
TO RAM 149 (FIG.7)
FROM FIG 9 FIFORD
FREEZE
FROM FIG. 11
FIFO
CLKA-
FROM FIG. 8
MAG. COMP. P/Q
PS FLIP-FLOP
4MHZ
FROM FIG. 8
CLKA-
LATCH
CLK
CLR
CLKC-
FROM FIG. 8
FIG. 10
160
A/D
VREF
VIN
4MHZ
FROM FIG. 6
TO FIG. 10
FIFORD
COUNTER
UP
CARRY
CLKA
FROM FIG. 8
CLR FLIP-FLOP
PEAK
ENGSYNC
FROM FIG. 9
FROM FIG. 6
+V
30 DISPLAY SAMPLE CLOCK
CLKA
CLKA-
CLKB-
CLKC
CLKC-
CLKB
QUAD FLIP-FLOP
SETUP
FROM MICRO 145 (FIG. 7)
PS FLIP-FLOP
V+
CLOCK
TO FIG. 9
150
PORT EXPANDER AND COUNTER
ANCLKA
ANCLKB
TO FIG. 6
COUNT DATA
ADDRESS
4MHZ
FIG. 8
SETOUT
TO FIG. 11
PS FLIP-FLOP
FIFORD
FROM FIG. 8
CLKB-
CLKC-
FLIP-FLOP
TO FIG. 11
TO FIG. 10
CSYNC
BLOCKT
CYLID
RBLK
PEAK
PORT EXPANDER AND COUNTER
ADDRESS
DATA
CLOCK
FROM FIG. 8
FIG. 9
155

60
FROM FIG. 12
TO FIG. 12
VIDEO
62
DOTCLK
61
61a
VERTDR
VIDTXD
COMTXD
63
235
RAM
237
CONTROL LOGIC
BDOT
PRINT DATA
239
LATCH
236
ADDRESS COUNTER
233
238
ADDRESS
LD
TRIG
232
E PROM
235a
RAM
MICRO
230
234
DATA
231
XMTR/ RCVR
PORT A
PORT B

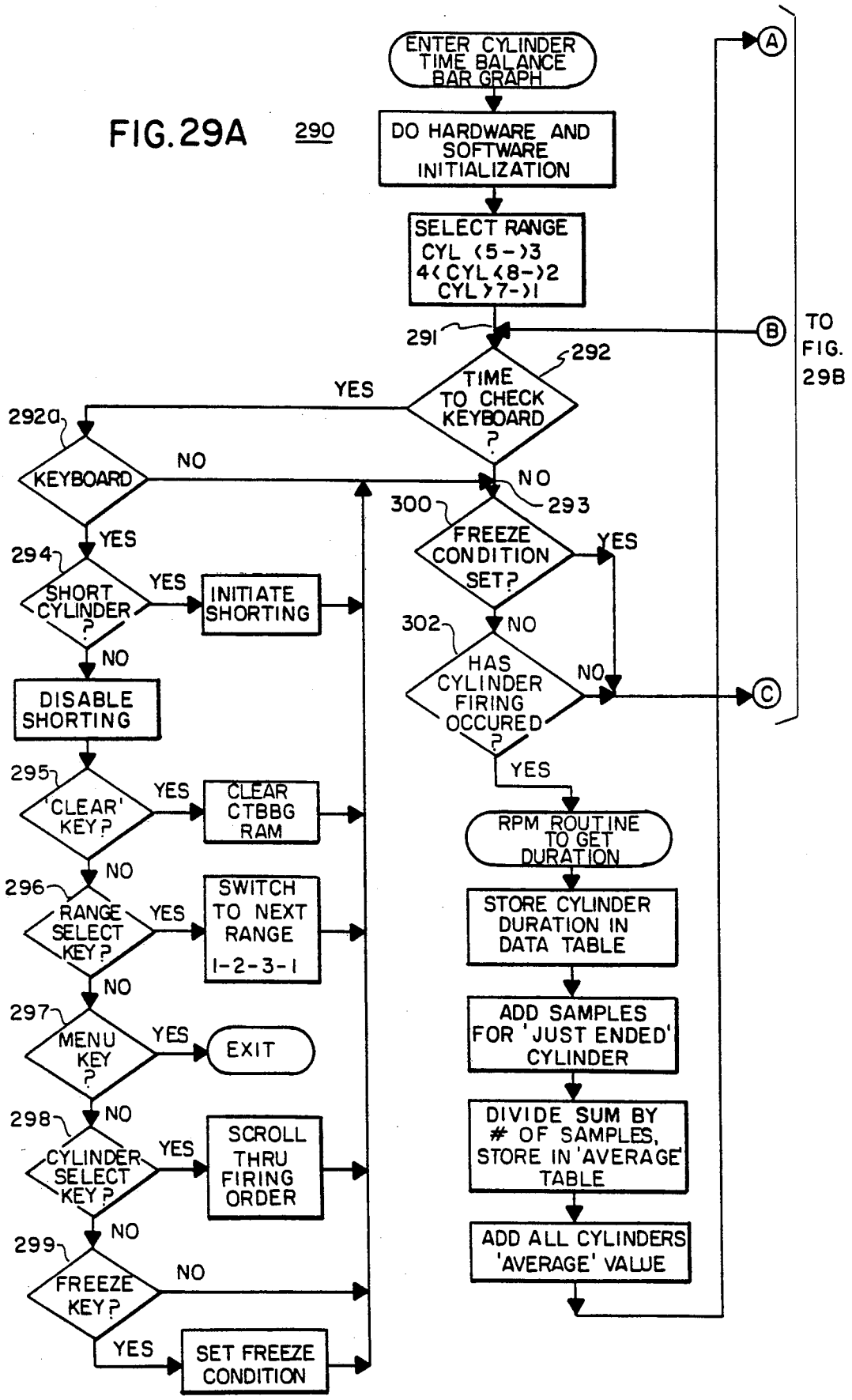
FIG. 29A
290
ENTER CYLINDER TIME BALANCE BAR GRAPH
DO HARDWARE AND SOFTWARE INITIALIZATION
SELECT RANGE CYL (5->3 4< CYL <8->2 CYL >7->1
291
292
TIME TO CHECK KEYBOARD ?
YES
NO
292a
KEYBOARD
NO
YES
294
SHORT CYLINDER ?
YES
INITIATE SHORTING
NO
DISABLE SHORTING
295
'CLEAR' KEY ?
YES
CLEAR CTBBG RAM
NO
296
RANGE SELECT KEY ?
YES
SWITCH TO NEXT RANGE 1-2-3-1
NO
297
MENU KEY ?
YES
EXIT
NO
298
CYLINDER SELECT KEY ?
YES
SCROLL THRU FIRING ORDER
NO
299
FREEZE KEY ?
NO
YES
SET FREEZE CONDITION
NO
293
300
FREEZE CONDITION SET ?
YES
NO
302
HAS CYLINDER FIRING OCCURED ?
NO
YES
RPM ROUTINE TO GET DURATION
STORE CYLINDER DURATION IN DATA TABLE
ADD SAMPLES FOR 'JUST ENDED' CYLINDER
DIVIDE SUM BY # OF SAMPLES, STORE IN 'AVERAGE' TABLE
ADD ALL CYLINDERS 'AVERAGE' VALUE
A
B
C
TO FIG. 29B

DIGITAL ENGINE ANALYZER

This is a division of application Ser. No. 587,357, filed Sep. 24, 1990.

BACKGROUND OF THE INVENTION

1. Field of the Invention

This invention relates to methods and apparatus for electronically diagnosing and analyzing the performance of internal combustion engines. The invention relates particularly to digital engine analyzers of the type which display digitized information on an oscilloscope screen.

2. Description of the Prior Art

The present invention is an improvement of the digital engine analyzer disclosed in U.S. Pat No. 4,800,378. One of the waveforms commonly analyzed in engine analyzers of that type is the secondary ignition pattern, which has a distinctive shape. The pattern includes a high-amplitude spike of very short rise and fall times at the beginning of the cylinder power stroke, caused by the buildup of voltage across the spark plug just prior to its firing; a plateau region of medium amplitude, which is the "burn time" when the spark plug is actually firing; and an oscillatory or "ringing" portion after termination of the spark plug firing. It will be appreciated that the power stroke is the movement of the piston away from the spark plug in response to combustion of the fuel, thereby delivering power to the crankshaft.

Heretofore the spark plug burn time has rarely been used as a diagnostic aid. However, useful diagnostic information can be gained by determining the spark plug burn time, and particularly by comparing the spark plug burn times of the several cylinders. For example, short burn times may be indicative of fouled plugs and/or high resistance in the secondary of the ignition. Comparisons of burn times can determine if one or more cylinders may have faulty spark plugs and/or high resistance in the ignition components.

It is known to measure the spark plug burn time, one system for doing so being disclosed in U.S. Pat. No. 4,291,383. But such prior art systems simply display numerical data for the spark plug burn times, which makes it difficult to readily compare the burn times of the several cylinders. Furthermore, such systems require the use of input signals from both the primary and the secondary of the ignition coil in order to derive the burn time information.

One of the principal diagnostic techniques utilized in prior engine analyzers is the display in kilovolts of the peak voltage across the spark plug for each cylinder firing. In the aforementioned U.S. Pat. No. 4,300,378, this information is displayed in a number of ways, viz., a display of the secondary waveform itself, a bar graph of the peak values for the several cylinders, and the display of numerical minimum and maximum values for each cylinder. But none of these techniques permits the analysis of the peak voltage performance of a single cylinder over time, independently of the other cylinders.

Another diagnostic technique used in prior engine analyzers is cylinder shorting, i.e., shorting out the ignition voltage to a selected cylinder. The purpose of cylinder shorting is to determine the contribution of each individual cylinder to the overall power output of the engine by successively shorting, or preventing operation of, selected cylinders and noting the effect on the speed of the engine. If the cylinder were contributing no power, then the shorting of that cylinder would not decrease the engine speed. If, on the other hand, the individual cylinder being shorted were a normal contributor to the overall power, then the speed of the engine would drop in response to the shorting. If each individual cylinder contributed the same amount to the overall power, then the shorting of each cylinder would result in substantially the same speed drop.

In modern computer-controlled engines with catalytic converters it is difficult and potentially harmful to short out cylinders. Indeed, engine manufacturers specifically warn against the use of this technique. Accordingly, at least one prior system has obtained an indication of the cylinder-by-cylinder power contribution or power "balance" without shorting the cylinders, by means of measuring the variations in firing times between the cylinders. The system provides a bar graph of the variations in firing times between the cylinders. But this display shows the time variation for each firing and, therefore, can experience considerable flutter over several engine cycles, making it difficult to read.

In a digital engine analyzer, the analog engine signals are converted into digital information by sampling the analog waveform at a predetermined rate and generating digital representations of the sample values. That digital information is stored and then displayed on the oscilloscope screen. The oscilloscope is a cathode-ray tube, and the display thereon consists of a multiplicity of dots arranged in horizontal rows with a predetermined number of dots in each row, this number representing the maximum number of samples which can be simultaneously displayed across the screen, which places an upper limit on the resolution of the waveform display. This is not a problem if the amplitude of the analog waveform is relatively constant over time or the rate of change thereof is not great. However, during those portions of the waveform containing very rapid rise and fall times, such as during the spike portion at the beginning of the cylinder ignition waveform pattern, it is difficult or impossible to faithfully represent the actual waveform on a digital oscilloscope wherein an entire cylinder period is to be displayed.

This problem can be solved by increasing the sampling rate, but if all the samples are displayed this would prevent an entire cylinder period from being displayed on the screen. In the aforementioned U.S. Pat. No. 4,800,378, the spike portion of the cylinder ignition waveform is displayed by capturing the analog peak value and digitizing it and then later inserting that value in the displayed waveform. But the insertion doesn't occur until the following engine cycle at the earliest, and a new peak is captured only once every several engine cycles, depending on engine speed, so that the displayed waveform is not a true "live" waveform. Furthermore, the peak value might get inserted at the wrong point, resulting in distortion of the waveform.

Most modern automobile engines have on-board computers which control and/or monitor a number of different engine parameters and which produce a serial data stream indicating the status of monitored parameters. This data stream may be accessed through the Assembly Line Data Link (ALDL) connector on the engine. Hand-held diagnostic instruments, known as scanners, are adapted to plug into the ALDL connector and access the serial data stream and interpret and display the information. But such scanners have very limited displays.

U.S. Pat No. 4,602,127 discloses the concept of interfacing such a scanner with an engine analyzer so that all of the parameter data available to the scanner can be simultaneously displayed on the cathode-ray tube of the analyzer, but the patent does not disclose any means for accomplishing this result. Furthermore, the scanner must be utilized close to the engine, while the engine analyzer may be remotely located and, therefore, it may be difficult for the operator to read the engine analyzer display while at the same time operating the scanner controls.

SUMMARY OF THE INVENTION

It is a general object of the present invention to provide an improved digital engine analyzer which avoids the disadvantages of prior analyzers while affording additional structural and operating advantages.

An important feature of the invention is the provision of a digital engine analyzer which is of improved construction, permitting the performance of unique diagnostic tests and providing simplified and/or improved performance of standard diagnostic tests.

A significant feature of the invention is the provision of an analyzer of the type set forth, which provides a display of spark plug burn time information which permits ready comparison of the burn times of the several cylinders.

In connection with the foregoing feature, another feature of the invention is the provision of an analyzer of the type set forth, which derives spark plug burn time information from only a single analog input signal.

Yet another feature of the invention is the provision of an analyzer of the type set forth which provides for a historical display of the peak ignition voltage values for a selected cylinder over a number of engine cycles.

In connection with the foregoing feature, another feature of the invention is the provision of an analyzer of the type set forth, which provides a continuously updated or running graphical display of the historical peak voltage data.

Still another feature of the invention is the provision of an analyzer of the type set forth, which provides a relatively stable display of cylinder time balance information, so as to give an indication of cylinder-by-cylinder power contribution without shorting the cylinders.

Another feature of the invention is to provide a digital analyzer of the type set forth, which permits a substantially accurate representation of portions of an analog waveform having very short rise and fall times, while at the same time permitting an entire cylinder period of the waveform to be displayed on the screen.

In connection with the foregoing feature, it is another feature of the invention to provide an analyzer of the type set forth, which is capable of switching into a high resolution mode for a short period of time sufficient to relatively accurately reproduce the steep-sloped portion of the waveform.

It is another feature of the invention to provide an analyzer of the type set forth which interfaces with a scanner adapted for connection with a vehicle on-board computer, and which permits the scanner control functions to be effected from the analyzer.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 8 is a block diagram of the display sample clock generator of the digital circuits of FIG. 7;

FIG. 9 is a block diagram of the screen delay circuit of the digital circuits of FIG. 7;

FIG. 10 is a block diagram of the waveform sample and store circuit of the digital circuits of FIG. 7;

FIGS. 29A–29C are a flow diagram of the cylinder time balance bar graph subroutine of the engine analyzer programs with FIG. 29C showing an interrupt in the subroutine;

DESCRIPTION OF THE PREFERRED EMBODIMENT

Figure 1:
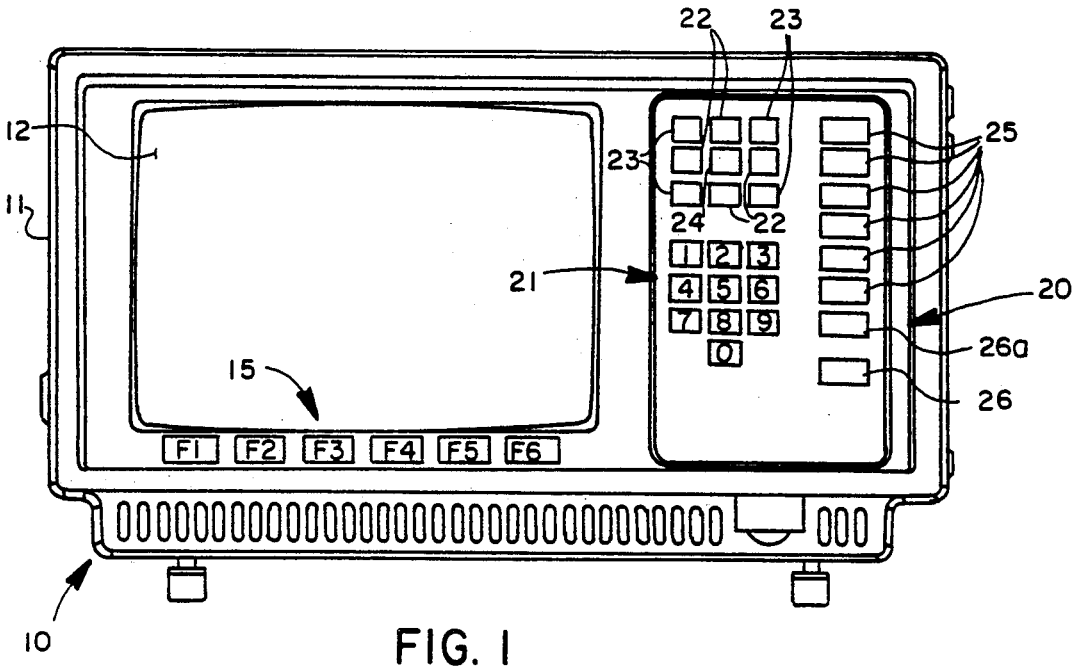
FIG. 1 is a front elevational view of an engine analyzer constructed in accordance with and embodying the features of the present invention.
Figure 1A:
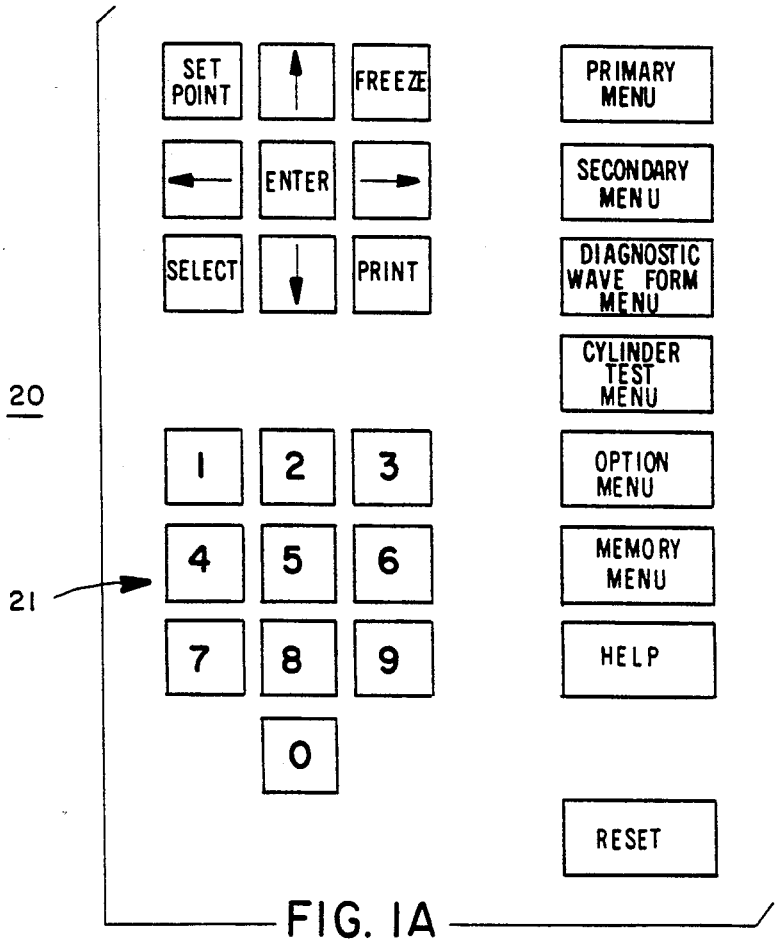
FIG. 1A is an enlarged view of the main keyboard of the analyzer of FIG. 1.

Referring to FIGS. 1 and 1A there is illustrated a digital engine analyzer, generally designated by the numeral 10, constructed in accordance with and embodying the features of the present invention. The analyzer 10 is disposed in a cabinet 11 and includes a cathode ray tube monitor screen 12 in the form of a digital oscilloscope. Arrayed along the bottom edge of the screen 12 is a set 15 of six "soft" keys, F1 through F6, the functions of which are software-controlled and vary with the mode of operation of the analyzer 10, as will be explained in greater detail below. More specifically, the software for controlling the operation of the analyzer 10 causes an indication of each soft key's function to be displayed on the screen 12 immediately adjacent to the key.

The analyzer 10 also has a main keyboard 20, which includes a numerical keypad 21 including 10 keys for digits 0 through 9, respectively; four directional keys 22 for the directions up, down, right and left, four function keys 23 for respectively actuating SET POINT, FREEZE, PRINT, and SELECT functions; an ENTER key 24; six menu keys 25; a RESET key 26; and a HELP key 26*a*. In the operation of the analyzer 10, as will be explained more fully below, the numerical key pad 21 is used for selecting cylinders, inputting engine information and specifying the rpm set point. The ENTER key 24 is used for entering information input with the numerical keypad 21. The directional keys 22 serve to move the cursor and expand or position waveforms. The FREEZE function freezes any "live" test screen, i.e., a screen which follows varying input information. The key operates on a toggle basis, i.e., pressing it once freezes the display and pressing it again unfreezes the display. The SET POINT function calls up an automatic freeze feature when the engine reaches a keyed-in rpm. The print feature prints the displayed screen on an associated optional printer. The SELECT function selects between the two horizontal and the two vertical cursors when measuring a waveform.

Figure 26A:
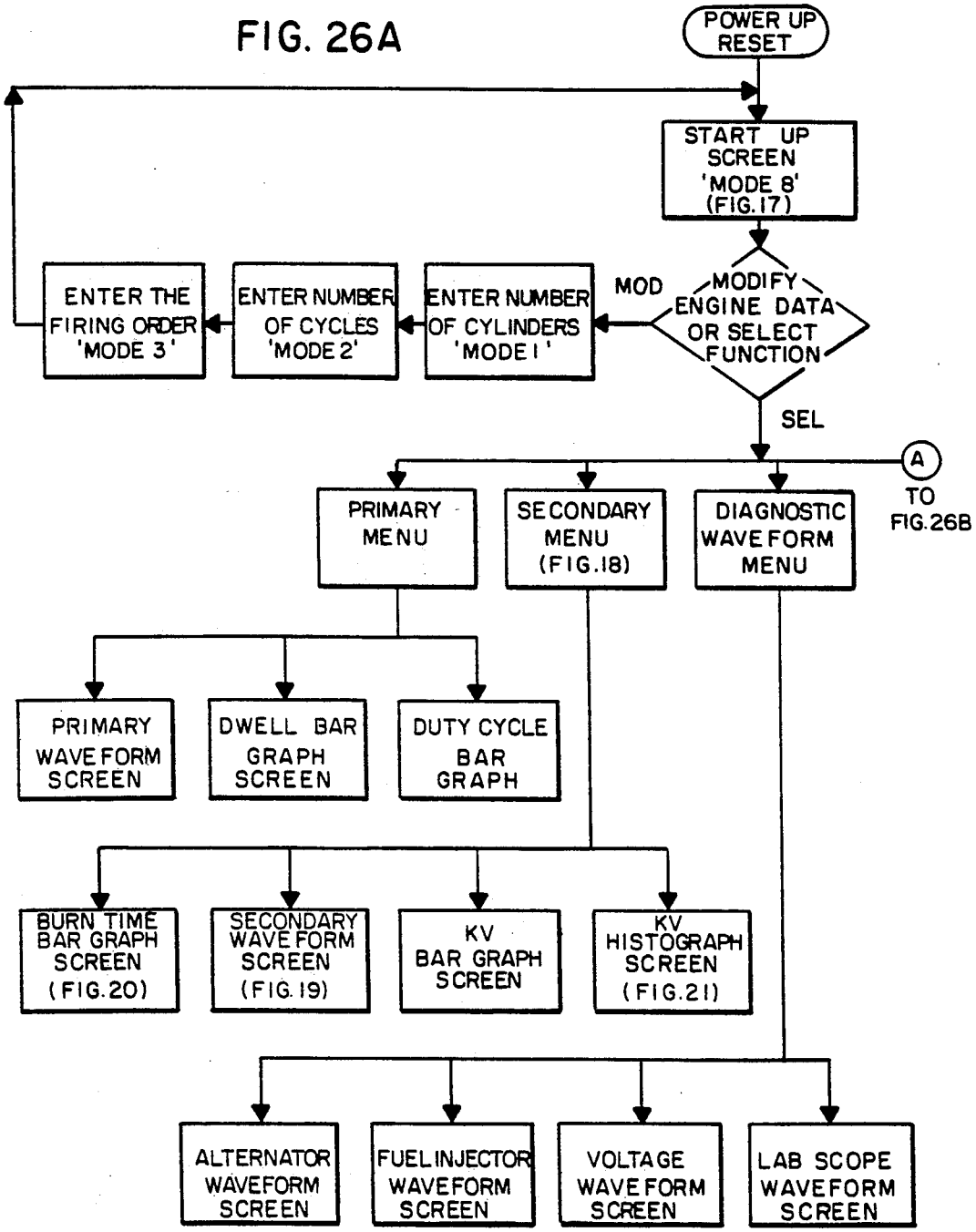
FIGS. 26A and 26B are a simplified, generalized flow diagram of the menus and other display screens provided by the programs of the engine analyzer of FIG. 1.
Figure 26B:
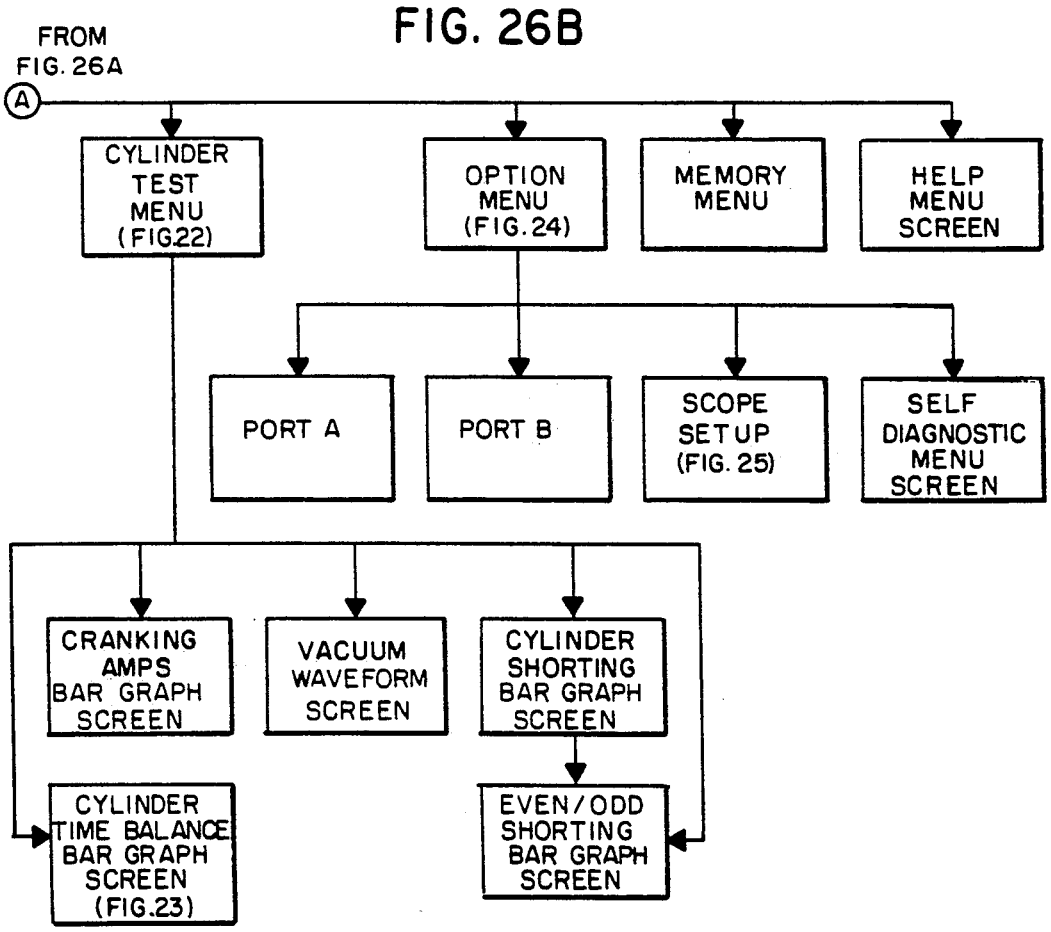

The menu keys 25 include a PRIMARY MENU key which is used to display a menu of primary ignition tests; a SECONDARY MENU key, used to display a menu of secondary ignition tests, including Burn Time Bar Graph, KV Histograph and Secondary Waveform; a DIAGNOSTIC WAVEFORM MENU key, used for displaying a menu of diagnostic waveforms; a CYLINDER TEST MENU key, used for displaying a menu of cylinder tests, including Cylinder Time Balance Bar Graph; an OPTION MENU key, used to display a menu of options, including identification of the devices, if any, connected to ports A and B and a Scope Setup screen for user definition of the devices connected to port A and port B; and a MEMORY MENU key used to display a menu of screens in memory which can be cleared or recalled. A complete listing of the menu items accessible through each of the menu keys 25 is illustrated in FIGS. 26A and 26B. The RESET key 26 clears the current screen display and returns the system to a start-up Engine Information Screen. The HELP key 26*a* displays either a help menu or information about the current screen.

Figure 5:
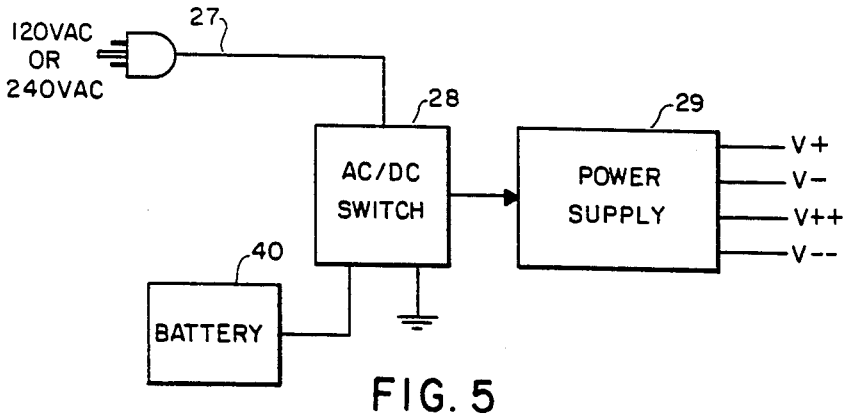
FIG. 5 is a partially schematic and partially block diagram of the power supply system for the engine analyzer of FIG. 1.

Referring also to FIG. 5, the analyzer 10 includes an AC power cord 27 adapted to be plugged into an associated 120 or 240-volt, 50 or 60 Hz, AC supply. The analyzer 10 is provided with a suitable switch (not shown) for selecting between the 120 or 240 VAC sources. The analyzer 10 is also provided with suitable conductors for connection to an associated source of DC power, such as a battery 40, which may be the battery of the vehicle under test. The AC and DC sources are connected to an AC/DC switch 28 for selection between the two, the output of the switch 28 being coupled to a suitable power supply circuit 29 for generating a number of DC voltages of different polarities, respectively designated V+, V−, V++, V−−, for use by the internal circuitry of the analyzer 10.

Figure 2:
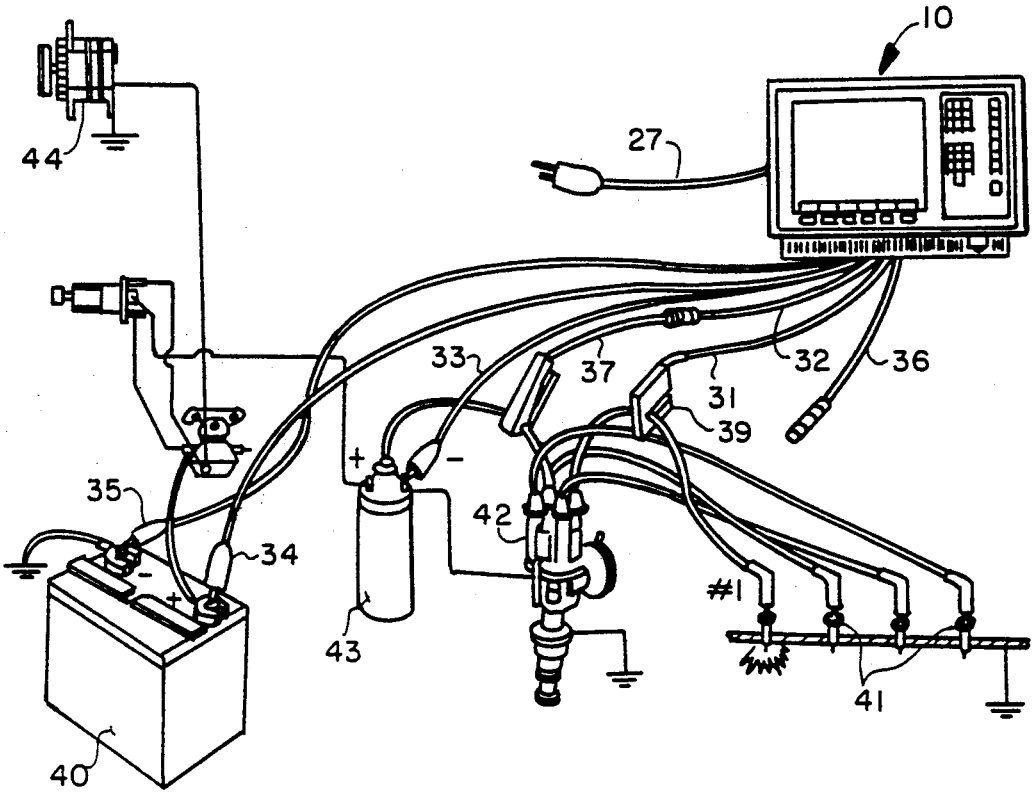
FIG. 2 is a view, partially in elevation and partially in perspective, of the engine analyzer of FIG. 1, showing the lead connections for testing an ignition system with a remote coil.
Figure 3:
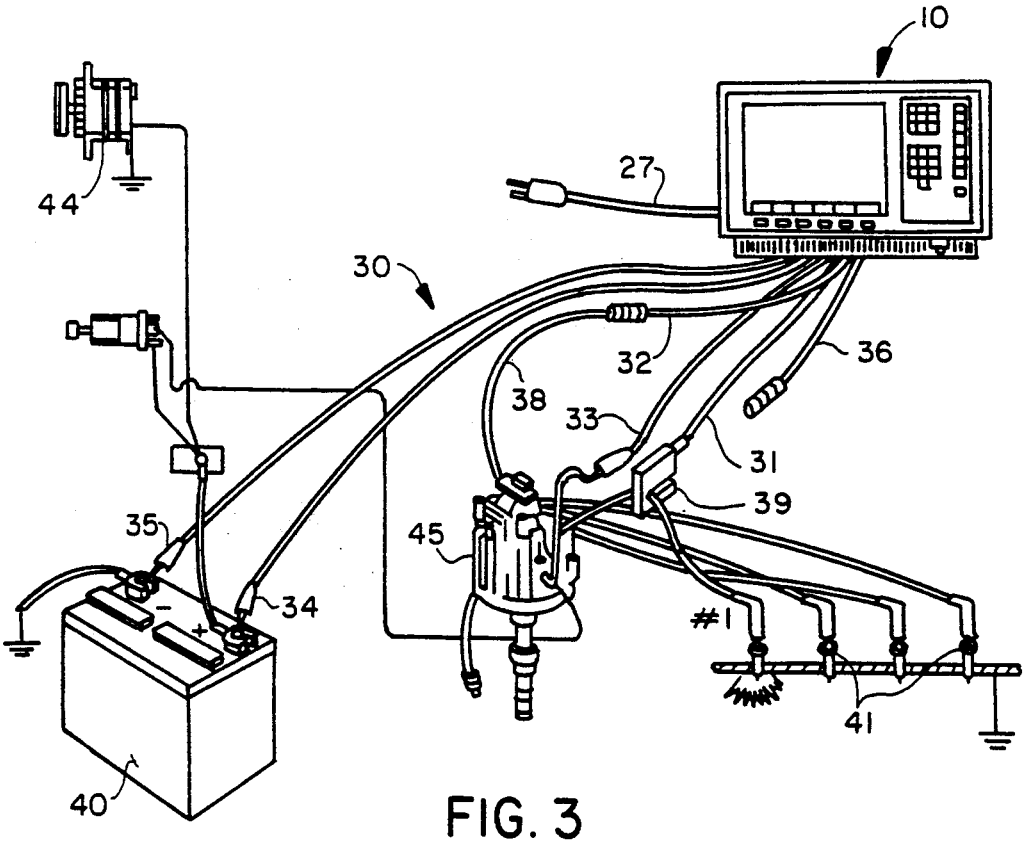
FIG. 3 is a view similar to FIG. 2, illustrating the lead connections for testing an integral-coil type ignition system.

Referring to FIGS. 2 and 3, the analyzer 10 is also provided with a lead set 30, including an inductive pickup lead 31, a secondary lead 32, a primary/fuel injection lead 33, an alternator/battery lead 34, a ground lead 35, and an auxiliary lead 36. The secondary lead is provided at its distal end with a suitable coupling for connection to a number of different adapters or pickups, including a capacitive pickup 37 (FIG. 2) and a high energy ignition (HEI) pickup 38 (FIG. 3). The inductive pickup lead 31 is provided at its distal end with a suitable inductive pickup clamp 39. The primary/fuel injection lead 33, the alternator/battery lead 34 and the ground lead 35 are all provided at their distal ends with suitable clips for attachment to associated engine parts. The auxiliary lead 36 is provided at its distal end with a suitable fitting for coupling to associated adapters, probes or pickups (not shown).

FIG. 2 illustrates a configuration of the lead set 30 for connection to an ignition system with a remote coil. In this configuration, the inductive pickup 39 is clamped over the wire of the number 1 spark plug of the spark plugs 41 for providing the analyzer 10 with the engine rpm data and a reference point for identifying cylinders in the firing order. The secondary lead 32 is coupled to the capacitive pickup 37, which is clamped over the secondary wire which runs between the rotor of a distributor 42 and the secondary winding of a remote coil 43. The primary/fuel injection lead 33 is connected to the negative or tach terminal of the coil 43 to monitor primary ignition and ignition dwell and to enable cylinder shorting. The battery lead 34 is connected to the positive terminal of the automotive battery 40 or to the output terminal of the alternator 44. The ground lead 35 is connected to the negative terminal of the battery 40 or other good vehicle ground.

FIG. 3 illustrates a configuration of the lead set 30 for connection to an integral coil type ignition 45, such as a General Motors HEI ignition. This arrangement is substantially the same as that in FIG. 2, with the exception that the secondary lead 32 is coupled to the HEI pickup 38, which is connected to the top of the integral coil ignition 45.

The primary/fuel injection lead 33 could also be coupled to a suitable fuel injector adaptor (not shown) to provide a fuel injection waveform. It will be appreciated that other types of couplers or adapters could be connected to the secondary lead 32 for use with other types of engines or ignition systems. The auxiliary lead 36 is not used in the arrangements of FIGS. 2 and 3, but provides for additional input pickups or probes, when necessary.

The engine analyzer 10 is designed to operate in a number of different modes for performing a number of different diagnostic tests on internal combustion engines. However, the present invention deals specifically with only the following modes and operational features:

1. Spark Plug Burn Time Bar Graph
2. KV Histograph (where "Histograph" designates a graphical display of a historical series of events)
3. Cylinder Time Balance
4. Waveform Digital Peak Capture
5. Scanner Interface Accordingly, only so much of the hardware and software of the engine analyzer 10 will be described in detail herein as is necessary for a complete understanding of the construction and operation thereof as regards the above-listed modes and operational features.

Figure 4:
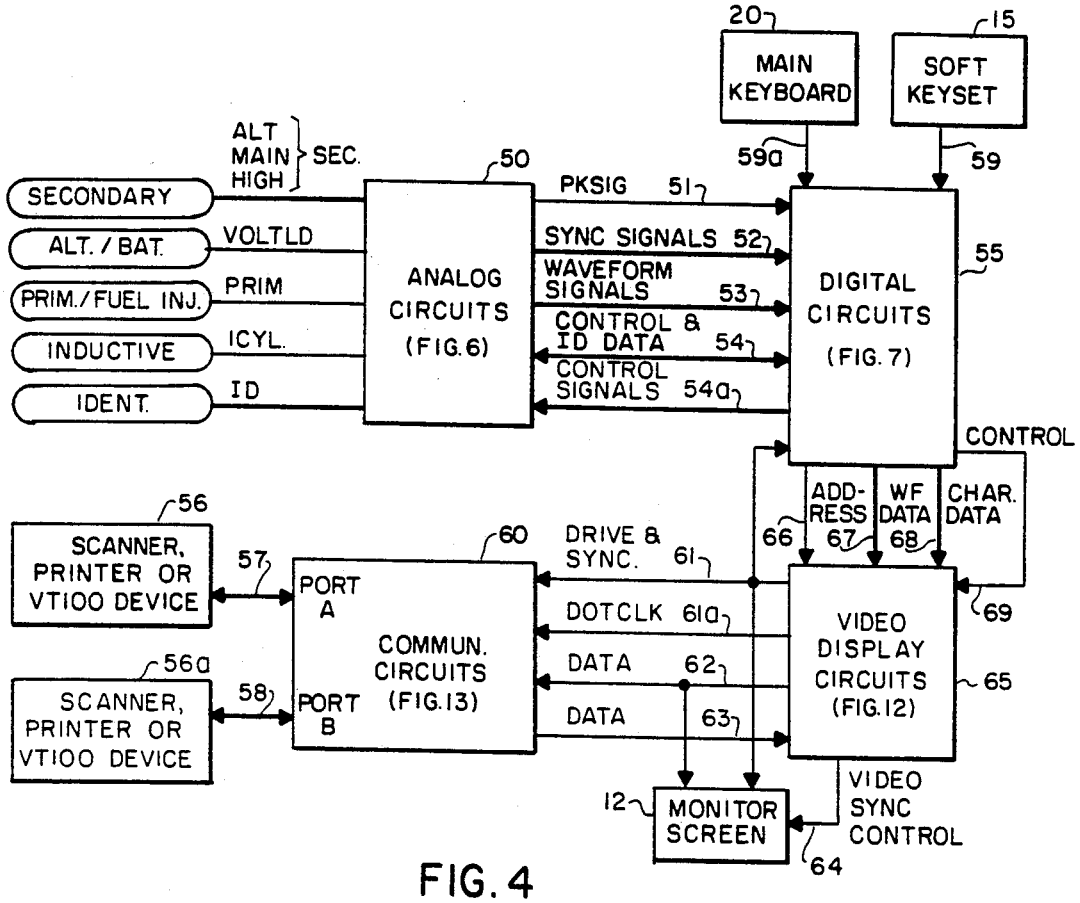
FIG. 4 is a functional block diagram of the circuitry of the engine analyzer of FIG. 1.

Referring now also to FIG. 4, the signals acquired by the several leads are applied to analog circuits 50. More specifically, there is input to the analog circuits 50 a signal 1CYL from the inductive pickup lead 31, a signal PRIM from the primary/fuel injection lead 33, a signal VOLTLD from the alternator/battery lead 34 and one or more of three secondary signals, respectively labeled ALTSEC, MAINSEC and HIGHSEC, from the secondary lead 32, depending upon the type of engine being analyzed and the type of pickup coupled to the inductive lead. In this regard, the secondary lead 32 is preferably a multi-conductor cable which connects to a multi-conductor pickup device, three of the conductors serving to provide a three-bit digital ID signal indicating to the analog circuits 50 an identification of the specific pickup being used and, thereby, an indication of the type of ignition system being analyzed. While not illustrated in FIG. 4, it will be appreciated that the auxiliary lead 36, when used, can also be coupled to multiple probe or pickup devices, and it is a multi-conductor cable which will similarly provide signals identifying the particular probe or pickup device used.

The analog circuits 50 are connected by a number of lines and buses to digital circuits 55. In particular, a PKSIG signal is applied to the digital circuits 55 via a conductor 51, a number of sync signals are applied thereto over line 52 and waveform signals are applied over line 53. Control and ID data is transferred between the analog circuits 50 and the digital circuits 55 via bidirectional bus 54, and control signals are sent from the digital circuits 55 to the analog circuits 50 via line 54*a*. The signals from the soft key set 15 and the main keyboard 20 are also applied to the digital circuits 55 via lines 59 and 59*a*, respectively.

The engine analyzer 10 also includes communication circuits 60 having ports A and B to which peripheral devices 56 and 56*a* may be coupled by bidirectional lines 57 and 58, respectively. Each of the peripheral devices 56 and 56*a* may be a scanner, a printer or other device using the VT100 communication protocol. A scanner is a hand-held device adapted to be coupled to a computer on-board a vehicle under test for accessing and reading out the data being monitored or collected by the on-board computer.

The communication circuits 60 are connected by line 61, and 61*a* and data buses 62 and 63 to video display circuits 65, the latter also being connected by a line 64 to the screen monitor 12 and by the line 61 and by buses 66 and 67 and lines 68 and 69 to the digital circuits 55. More specifically, the line 61 carries drive and sync signals from the video display circuits 65 to the digital circuits 55, to the monitor screen 12 and to the communication circuits 60. The line 61*a* carries a DOTCLK signal to the communication circuits 60. The bus 62 carries data from the video display circuits 65 to the communication circuits 60 and to the monitor screen 12. The line 64 carries video sync control signals to the monitor screen 12. The bus 63 carries data from the communication circuits 60 to the video display circuits 65. The buses 66 and 67, respectively, carry address information and waveform data, while the lines 68 and 69, respectively, carry character data and control signals from the digital circuits 55 to the video display circuits 65.

OPERATING MODES AND FEATURES

Before considering the electronic circuits of the engine analyzer 10 in greater detail, it will be helpful to briefly describe the user interface with the engine analyzer 10 as regards the above-listed operating modes and features. In this regard, the system software produces a number of screen displays on the monitor screen 12, which not only display test information, but also serve to guide the user through the operation of the analyzer 10. The major ones of these screen displays are outlined in FIGS. 26A and 26B.

Figure 24:
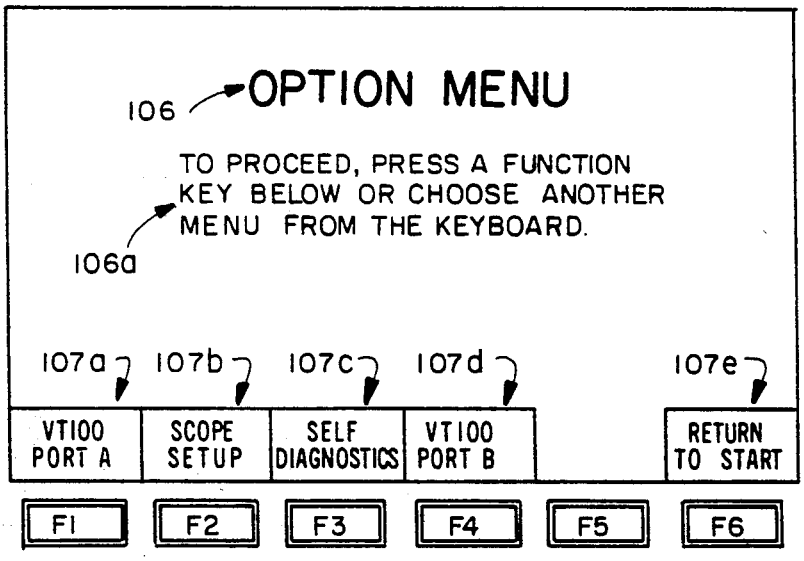
Figure 25:
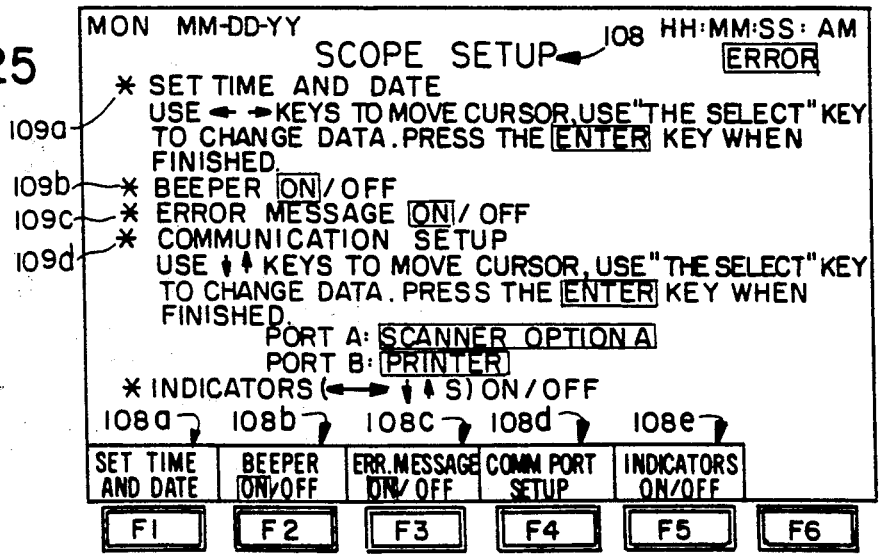

The Primary Menu, the Memory Menu and the Help menu are not pertinent to the present invention, but will be briefly described. The Primary Menu permits the user to access three test options, viz., a Primary Waveform screen which permits display of a primary waveform, a Dwell Bar graph screen which measures the closure time of the contact points in a breaker point ignition system or of an internal switch in an electronic ignition, and a Duty Cycle Bar Graph screen which permits display and measurement of fuel system duty cycle/dwell/voltage signals. The Memory Menu permits the screen display to be saved in "memory and later recalled. The Help menu permits access to various help instructions for user assistance in operating various features of the system. As will be explained below, specific help instructions can also be accessed from individual test screen displays. The following screen displays are pertinent to the present invention:

(a) Start-up (FIG. 17)
(b) Secondary Menu (FIG. 18)
(c) Secondary Waveform (FIG. 19)
(d) Burn Time Bar Graph (FIG. 20)
(e) KV Histograph (FIG. 21)
(f) Cylinder Test Menu (FIG. 22)
(g) Cylinder Time Balance (FIG. 23)
(h) Option Menu (FIG. 24)
(i) Scope Setup (FIG. 25)

Start-up

Upon powering up the engine analyzer 10, the user first sets the AC/DC switch 28 (FIG. 5) to the appropriate position, connects the analyzer 10 to the appropriate power source and actuates an ON/OFF switch (not shown). This will cause the start-up display of FIG. 17 to appear on the monitor screen 12. This screen permits the display of certain information regarding the engine under test, including the number of cylinders at 70, the number of cycles at 71 and the firing order of the cylinders at 72. The screen may also display a company logo or other identifying information at 73. An instructional message appears at 74, instructing the user to press one of the menu keys 25 (FIG. 1) or one of the soft keys F1–F6, labels for which respectively appear on the screen at 74*a* and 74*b* as "Modify Engine Data" and "Help". If the engine analyzer 10 has previously been used for testing a particular engine, the data for that engine will reappear at 70–72. If the user now wishes to test a different engine, he presses the "Modify Engine Data" soft key F1 which will call up the first of three screens (not shown) to permit the user to enter the appropriate data. More specifically, the first screen will instruct him to enter the number of cylinders. After that is entered, the second screen will automatically appear which will instruct him to enter the number of cycles, and finally a screen will appear instructing him to enter the firing order.

All this information is entered utilizing the numerical keypad 21. Since there are only ten numbered keys, on the first of these engine information screens, the soft keys F1–F6 will respectively be labeled 11-16 to permit the entry of a number of cylinders greater than ten. The cursor will automatically appear at the appropriate place for entry of the appropriate data and, as each number is entered, the cursor will automatically move to the position for the next entry. The directional keys 22 may be utilized to move the cursor for the purpose of correcting mistakes. Once the desired information has been keyed in, it is entered by pressing the ENTER key 24.

Figure 17:
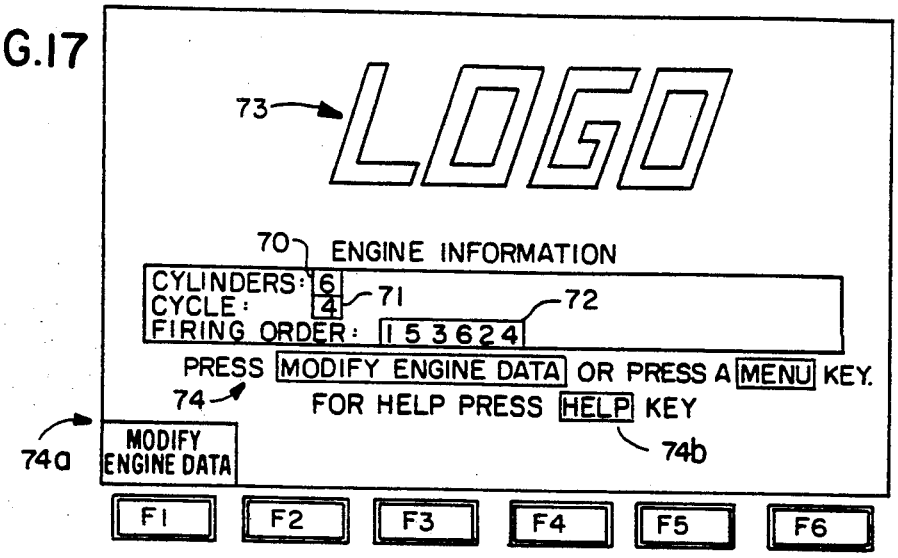
FIGS. 17–25 illustrate various screen displays provided by the engine analyzer of FIG. 1.

After the firing order information has been entered, the system will automatically return to the start-up display of FIG. 17. The user can then move to the desired test operation by pressing the appropriate one of the menu keys 25. If the user is unsure as to how to proceed during any part of the operation, he can press the HELP key 26*a* to bring up a help display to obtain assistance.

Secondary Menu

Figure 18:
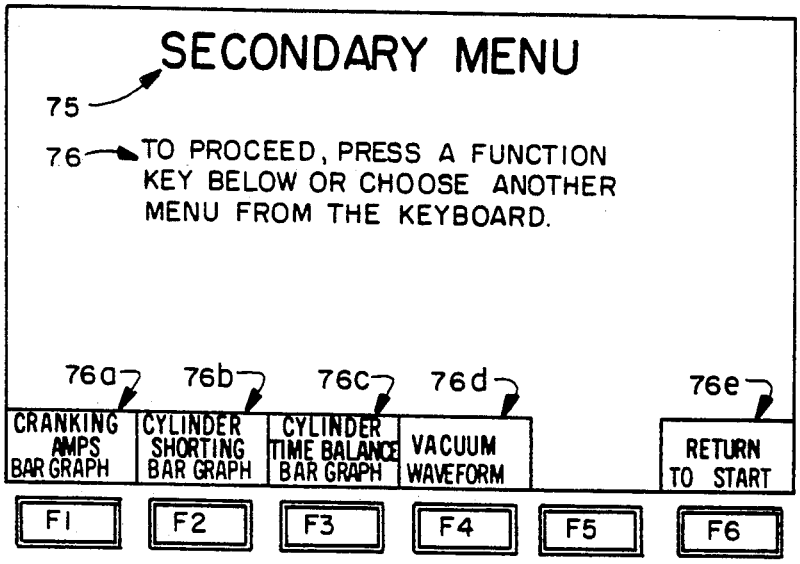

If the SECONDARY MENU key 25 is pressed, the screen display of FIG. 18 will appear. This screen includes a title at 75 and an instructional message at 76. For this particular menu there are five options, which are selected by means of the soft keys F1–F4 and F6, the labels for which are respectively displayed at 76*a*–76*e* as 37 Burn Time Bar Graph", "KV Bar Graph", "KV Histograph", "Secondary Waveform" and "Return to Start".

Actuation of the "KV Bar Graph" soft key F2 selects a screen display of a bar graph indicating the live or most recent cylinder firing voltage for each cylinder, and is not pertinent to the present invention.

The actuation of the "Return to Start" soft key F6 will recall the start-up screen display of FIG. 17.

Secondary Waveform

Figure 19:
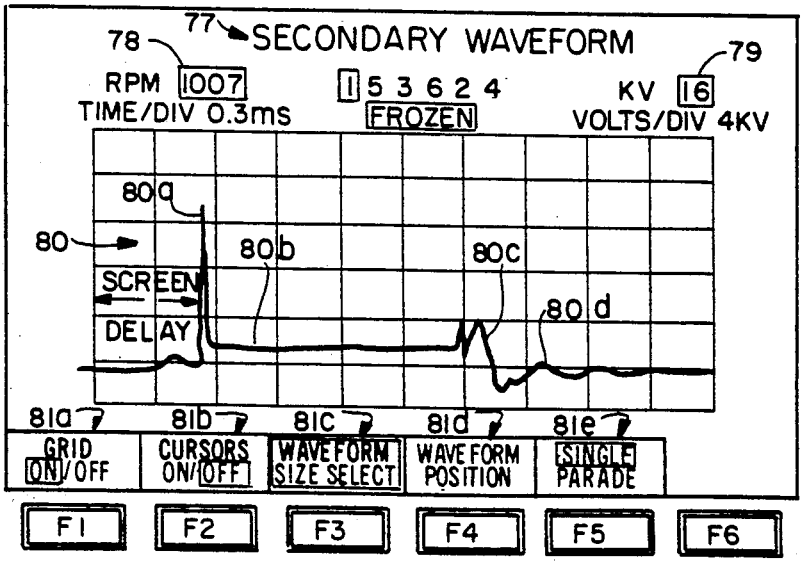

If the "Secondary Waveform" optionis selected, the display at FIG. 19 will appear. This display includes a title at 77, an indication of the engine rpm at 78 and the peak voltage reading of the secondary waveform in kilovolts at 79. The secondary waveform itself, which is the signal provided by the secondary lead 32, is displayed at 80. In FIG. 19 there is illustrated a secondary waveform pattern for a single cylinder. This waveform pattern has a characteristic shape which includes: a high-amplitude spike 80*a* of very short rise and fall times at the beginning of the cylinder power stroke, caused by the buildup of voltage across the spark plug just prior to its firing; a plateau region 80*b* of medium amplitude which is the "burn time" when the spark plug is actually firing; a drop-off portion 80*c* when the firing voltage being applied by the coil secondary is removed from the spark plug; and an oscillatory or "ringing" portion 80*d*. (The primary waveform pattern has a similar characteristic shape.) Labels for the soft keys F1–F6 are respectively shown at 81*a*–81*f* as "Grid On/Off", "Cursors On/Off", "Waveform Size Select", k"Waveform Position", "Single/Parade", and "True/-Wasted".

The "Grid On/Off" soft key F1 controls selection of the display of an internally-generated graticule for the waveform 80. The "Cursors On/Off" soft key F2 controls selection of the display of horizontal and vertical cursor lines. The "Waveform Size Select" soft key F3 allows the left and right directional keys 22 to be used to increase or decrease the size of the waveform being displayed. The "Waveform Position" soft key F4 calls up a display for operator selection of the positioning of the waveform pattern on the screen. The "Single/-Parade" soft key F5 calls up a screen display for operator selection of either a single waveform pattern for a single cylinder, as illustrated in FIG. 19, or a parade display of the patterns for all of the cylinders.

The "True/Wasted" option will appear only in the case of connection to a distributorless ignition (DI). In that case, there is typically a coil for every two cylinders, with each coil firing twice for a single engine cycle. Thus, every spark plug is fired twice, once in the compression stroke and once in the exhaust stroke, with the former being a "true" firing and the latter being a "wasted" firing. The display of either one can be selected by use of the screen called up by the soft key F6.

It will be noted that in FIG. 19 all six of the soft keys $F_1$–F6 are used. If more than six such options are desired, the excess selections will be displayed on a separate display screen or "page". In this case, the soft key F6 on the first display page will be labeled "Next Page", for selecting the next page, and the soft key F6 on the second page will be labeled "Previous Page" for returning to the first page.

Burn Time Bar Graph

Figure 20:
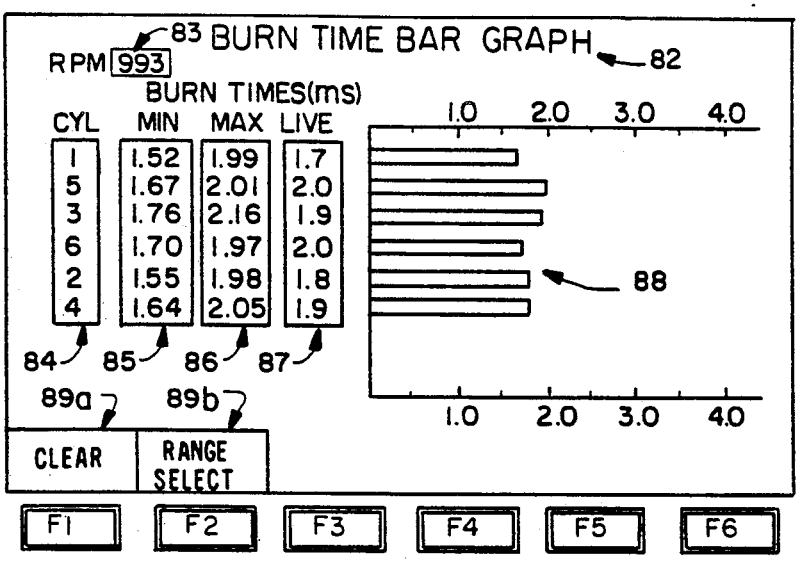

Pressing the "Burn Time Bar Graph" soft key F1 of FIG. 18 will call up the display of FIG. 20 for showing the burn time for each cylinder, wherein the burn time is the length of time that a spark is arcing between the electrodes of a spark plug. This screen display includes a title 82 and the engine rpm at 83. The cylinders are listed in a column at 84 in the firing order. Burn time values in milliseconds are listed in three columns, with minimum values listed at 85, maximum values at 86 and "live" or most recent values at 87. The "live" values are also illustrated in horizontal bar graph form at 88. Labels for the soft keys F1–F3, respectively, appear at 89*a*–89*c* as "Clear", "Range Select" and "True/-Wasted".

The "Clear" soft key F1 is utilized to clear data from the screen and to start acquiring fresh data. The "Range Select" soft key F2 calls up a display for user-selection of the number of screen divisions per unit of burn time. The "True/Wasted" label for soft key F3 appears only in the case of connection to a DI engine and serves the same purpose as was explained above with respect to FIG. 19.

Burn time bar graph information can be used to determine the condition of secondary ignition components. If the burn time for a single cylinder is much shorter or longer than those for the remaining cylinders, there may be a problem in relation to the firing of that particular cylinder. A fouled spark plug, for example, will typically fire at a lower peak voltage value and sustain a longer burn time. This may not always show up in the KV bar graph or histograph. For example, a fouled plug on GM's HEI ignition system shows up with an acceptable peak voltage value, but not an acceptable burn time. In this case, the problem is not so evident on KV test displays, but stands out well on the Burn Time Bar Graph display of FIG. 20.

KV Histograph

Figure 21:
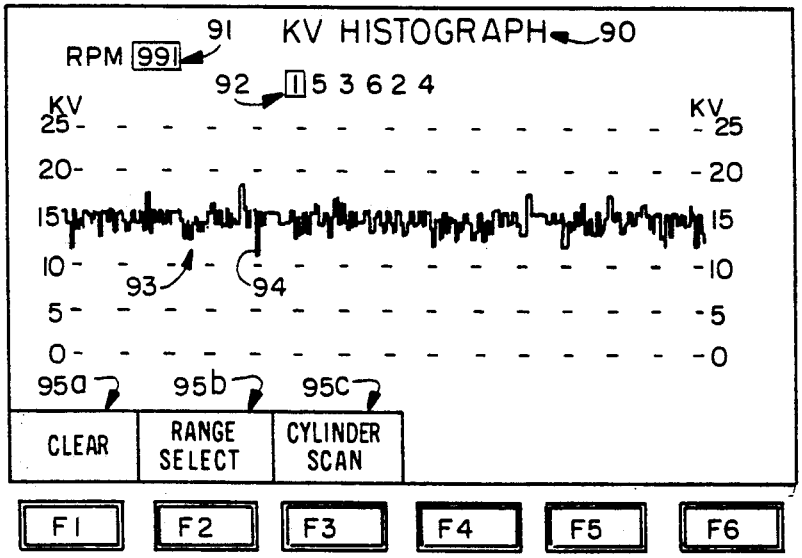

If the "KV Histograph" soft key F3 on the "Secondary Menu" screen of FIG. 18 is actuated, it calls up the screen display of FIG. 21. This display includes a title at 90, and the engine rpm at 91. The cylinder numbers are displayed at 92, with the cylinder under test being highlighted, as by inverse video display. The histograph pattern itself is displayed at 93 and comprises a graph of the peak voltage, in kilovolts, required to fire a selected cylinder over a plurality of successive engine cycles. The KV value for each firing is displayed at two consecutive raster locations on the screen to provide some visible width to that firing display, as indicated at 94. Thus, in a standard oscilloscope screen, 256 consecutive firings of the cylinder can be displayed simultaneously. The display begins to chart the most recent firing voltages on the right side of the screen and scrolls them to the left, with the "oldest" firings moving off the left side of the screen. The speed at which the display scrolls is proportional to engine speed.

The soft keys F1–F3 are respectively labeled at 95*a*–95*c* as "Clear", "Range Select" and "Cylinder Scan". The "Clear" soft key F1 is used to clear data from the screen. The "Range Select" soft key F2 is used for user selection of the vertical scale of voltage units per screen unit. The "Cylinder Scan" soft key F3 causes the system to automatically display one cylinder for five seconds, and then automatically move to the next cylinder and on through the firing order. Pressing this key again turns off the scan feature and returns to display of the preselected cylinder values. The cylinder is selected by use of the numerical keypad 21. If a DI engine is under test, an additional soft key will be labeled "True/-Wasted", as described above with respect to FIG. 20.

The KV histograph display gives information with respect to the actual firing voltage required, by observation of the overall position of the histograph on the screen with regard to the range scale selected. Changes in the firing voltage are detected by observation of variations between the individual firing values displayed. Occasional highs or lows in the firing voltages may indicate an intermittent problem in the cylinder under test.

Cylinder Test Menu

Figure 22:
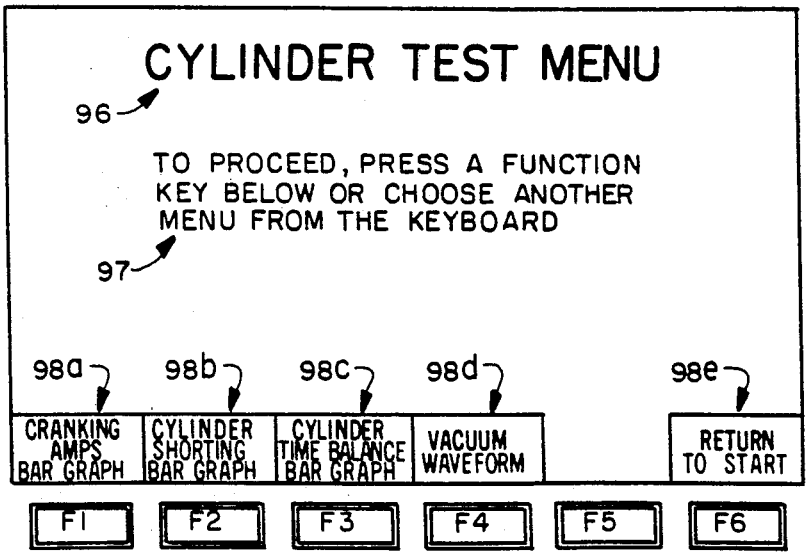

If the CYLINDER TEST MENU key 25 is actuated, it calls up the screen display of FIG. 22. This display includes a title at 96 and an instructional message at 97. This particular menu includes five options, selected by soft keys F1–F4 and F6, which are respectively labeled at 98*a*–98*e* as "Cranking Amps Bar Graph", "Cylinder Shorting Bar Graph", "Cylinder Time Balance Bar Graph", "Vacuum Waveform" and "Return to Start". The "Cranking Amps Bar Graph", "Cylinder Shorting Bar Graph" and "Vacuum Waveform" test features are not pertinent to the present invention and will not be further described. The "Return to Start" soft key F6 serves the same function as was explained above in connection with FIG. 18.

Cylinder Time Balance

Figure 23:
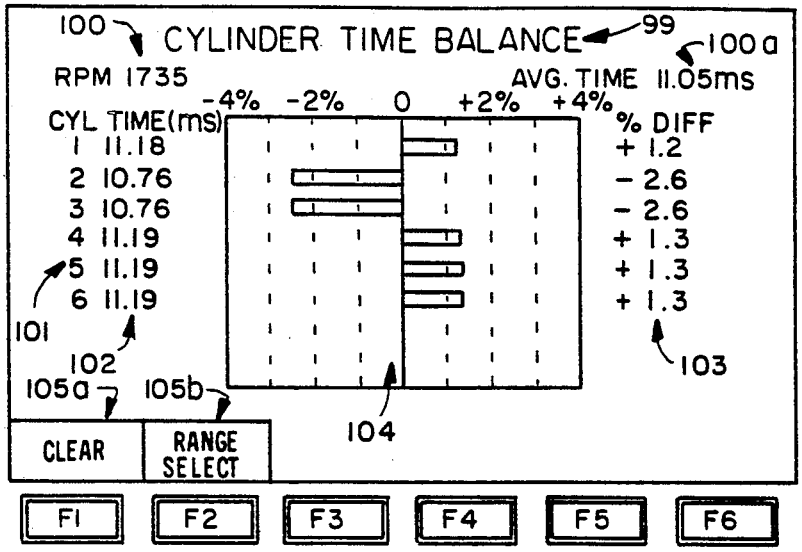

Actuation of the "Cylinder Time Balance Bar Graph" soft key F3 calls up the screen display of FIG. 23. This display includes a title at 99 and the engine rpm at 100. This screen display illustrates a comparison of the cylinder time periods for each of the several cylinders, wherein the cylinder time period for a particular cylinder is the time period from the application of the firing voltage to that cylinder to the application of the firing voltage to the next cylinder. Variations in the cylinder time periods from cylinder to cylinder can give an indication of the relative power contributions of the cylinders. The overall average of the cylinder time periods for all of the cylinders is shown at 100*a*. The cylinder numbers are listed in a column at 101 and opposite each cylinder number is shown its cylinder time period in milliseconds, at 102. The percentage differences between the cylinder time period for each cylinder and the overall average of all the cylinders is listed at 103 and is graphically shown in a bar graph at 104, wherein the vertical base line is the overall average of all of the cylinders, and individual cylinder time periods exceeding that average extend to the right of the base line and those less than the average extend to the left of the base line.

While it would be possible to display at 102 the actual latest value of the cylinder time period for each cylinder, this could result in sufficiently rapid changes in the display values to be annoying to the viewer. Accordingly, as will be explained in greater detail below, each of the cylinder time period values listed at 102 and graphed at 104 is actually an average of the cylinder time periods for the last ten firings of that cylinder, and the overall average at 100*a* is the overall average of the cylinder averages listed at 102.

The soft keys F1 and F2 are respectively labeled at 105*a* and 105*b* as "Clear" and "Range Select". Selection of the "Clear" soft key F1 simply clears data from the screen and begins a new accumulation of data. Actuation of the "Range Select" soft key F2 changes the scale of the units of percentage difference in cylinder time period per screen division unit.

The cylinder time balance information is useful, since it permits a convenient means of determining the relative power contributions of the cylinders without having to short a cylinder, which can be harmful in some newer engines.

Option Menu

Pressing the OPTION MENU key 25 calls up the screen display of FIG. 24. This display includes a title at 106 and an instructional message at 106*a* which directs the user to select among five options by the use of the soft keys F1–F4 and F6. The soft keys F2, F3 and F6 are, respectively, labeled at 107*a*–107*c* as "Scope Setup", "Self Diagnostics", and "Return to Start". The soft key F1 may have no label or may be labeled "Scanner Port A" or "VT100 Port A", and the soft key F4 may have no label or may be labeled "Scanner Port B" or "VT100 Port B", depending upon what is selected in the Scope Setup procedure, described below. The "Self Diagnostics" feature is not pertinent to the present invention. The "Return to Start" soft key serves the same function as was explained above in connection with FIG. 22.

Actuation of the "Scope Setup" soft key F2 calls up the screen display of FIG. 25, which is utilized for user selection of certain operating conditions. The screen display includes a title at 108 and permits selection among five types of operating conditions by use of the soft keys F1-F5, which are respectively labeled at 108*a*-108*e* as "Set Time and Date", "Beeper On/Off", "ERR Message On/Off", "Comm Port Setup" and "Indicators On/Off". The screen also includes instructional messages 109*a*-109*e* which, respectively, correspond to the soft key selections and explain for each selection how to effect the change of operating condition for that selection. The "Set Time and Date", the "Beeper On/Off", the "ERR Message On/Off" and the "Indicators On/Off" selections are not pertinent to the present invention. If the "Comm Port Setup" selection is made, the user can select the type of device, if any, which is connected to each of the ports A and B. The up and down directional keys 22 are used to move the cursor between the port A and port B messages, and the SELECT key 23 is used to scan among the several possible device options. Each time the SELECT key is pressed, the system will scan to the next option which will then appear next to the corresponding port designation. The options include a printer, any one of three different scanners, another device using the VT100 communications protocol, or no device at all, in which case "OFF" will appear on the screen for that port.

Where a VT100 device is selected, the label for the corresponding soft key (e.g., F1) on the option menu screen (FIG. 24) will be "Scanner Port A" or "VT100 Port A", respectively. If a printer or no device is selected, the corresponding soft key F1 or F4 on the option menu screen display of FIG. 24 will have no label. If a scanner or VT100 device is selected, actuation of the corresponding soft key (F1 or F4) on the option menu screen display of FIG. 24 will activate a suitable program sub-routine which is designed to interface with a corresponding device type and will call up a screen display (not shown) for that device type. More specifically, as will be explained in greater detail below, the selected screen display will have soft key labels corresponding to function keys on the device and the program will permit those device functions to be actuated by operation of the soft keys F1-F6 of the engine analyzer 10.

Analog Circuits

Figure 6:
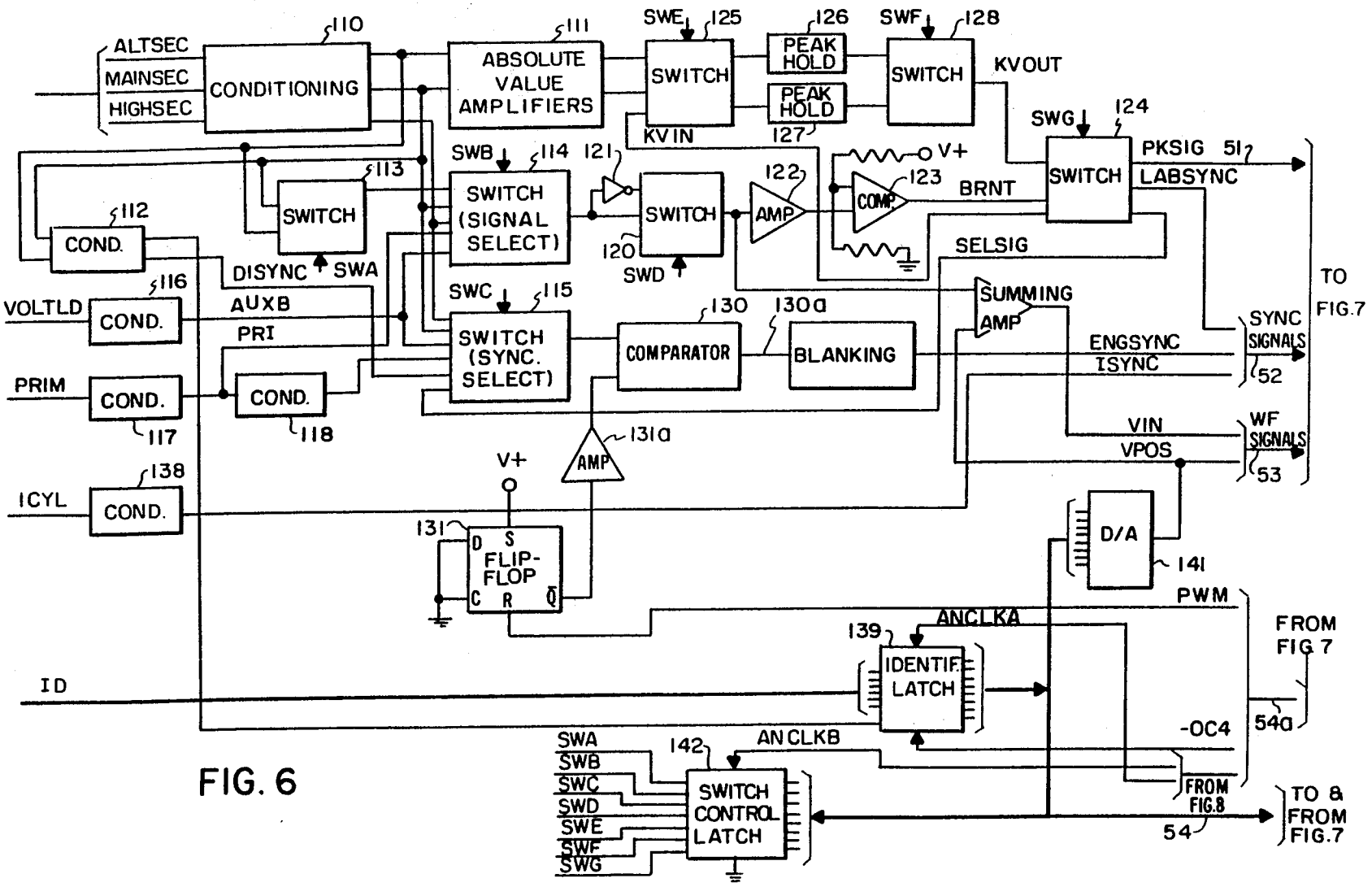
FIG. 6 is a partially schematic and partially block diagram of the analog circuits of the engine analyzer circuitry of FIG. 4.

The basic function of the analog circuits 50 is to provide an interface between the lead set 30 and the remaining circuitry of the engine analyzer 10. It receives the analog input signals from the lead set and places them in proper condition for handling by the digital circuits 55. Referring to FIG. 6 the secondary signals ALTSEC, MAINSEC and HIGHSEC from the secondary lead 32 are applied to conditioning circuitry 110, which preferably includes three separate channels of circuitry for respectively adjusting the levels of the three different secondary signals to provide an adequate size display on the monitor screen 12, and buffering to provide isolation between the engine analyzer 10 and external devices. Which of the three different secondary signals is present will depend upon the type of pickup device coupled to the secondary lead which will, in turn, depend on the type of ignition system under test.

Normally, there will be only one secondary signal, but in the case of a DI engine there will be two secondary signals present, typically ALTSEC and MAINSEC. From the conditioning circuitry 110, the ALTSEC and MAINSEC signals are applied to absolute value amplifiers 111, which simply detect the magnitude of the voltage signals, which may be either positive-going or negative-going, and output them as positive-going signals. These amplifiers are required only for DI inputs. The ALTSEC and MAINSEC signals are also applied to conditioning circuitry 112, which produces the signals DISYNC and DIPOL. The conditioned ALTSEC and MAINSEC signals from the conditioning circuitry 110 are also applied to an electronic switch 113 which selects between the two inputs in response to a control signal SWA, and outputs the selected signal to an electronic signal select switch 114. The conditioned MAINSEC and HIGHSEC signals from the conditioning circuitry 110 are also applied directly to the switch 114, as well as to an electronic switch 115.

The VOLTLD signal from the alternator/battery lead 34 is applied through conditioning circuitry 116 which outputs the signal AUXB to the switches 114 and 115. The PRIM signal from the primary/fuel injection lead 23 is applied to conditioning circuitry 117, which produces an output signal PRI which is applied directly to the switch 114. The PRI signal is also further conditioned in conditioning circuitry 118, the output of which is applied to the switch 115. Also input to the switch 115 is a SELSIG signal, the source of which will be explained below. The switch 114 is a signal select switch which effectively selects which one of the several input signals is to be displayed on the monitor screen 12, under the control of a switching signal SWB. The switch 115 is a sync select switch which, under the control of a signal SWC, selects which of the incoming signals is to be used as the sync source.

The selected output of the switch 114 is applied directly to one input of an electronic switch 120, and is applied through an inverter 121 to a second input of the switch 120, which selects the inverted or non-inverted signal under the control of a signal SWD, the selected signal being amplified in an amplifier 122 to produce a KVIN analog waveform signal. The KVIN signal is compared to a threshold voltage level in a comparator 123, which outputs a BRNT signal to an electronic switch 124. The KVIN signal is also applied directly to another input of the switch 124 to an input of an electronic switch 125, the other inputs of which receive the output signals from the absolute value amplifiers 111. The switch 125 operates under the control of a signal SWE to pass the two secondary signal inputs from the absolute value amplifiers 111, in the case of a DI engine, and apply them respectively to peak hold circuits 126 and 127. Otherwise, the switch 125 directs the KVIN signal to the peak hold circuit 127.

The peak hold circuits 126 and 127 are of conventional construction and capture the maximum or peak amplitude values of the input analog signals, which peak values are respectively fed to the two inputs of an electronic switch 128, which operates under the control of a signal SWF to select one of these inputs to produce an output signal KVOUT which is applied to another input of the switch 124. The KVIN signal is also applied directly to the switch 124. The switch 124 has three outputs and operates under the control of a signal SWG to switch the KVOUT signal to one output as a PKSIG signal, which is sent to the digital circuits 55. The BRNT signal is switched to a second output as a LABSYNC signal, which is also directed to the digital circuits 55. The KVIN signal is directed to the third output as the SELSIG signal which, as was explained above, is directed to an input of the switch 115 to use the displayed signal as the sync source.

The KVIN signal is also applied to a summing amplifier 129 which produces a waveform output signal VIN, which is sent to the digital circuits 55 over the line 53.

The sync source selected by the switch 115 is applied to a comparator 130, which compares it to a reference level. This reference level is variable and is proportional to the width of a control signal PWM received from the digital circuits 55 via the line 54*a*, and which is applied to the reset terminal of a flip-flop 131, which produces at its −Q output a pulse having a width proportional to the width of the PWM signal and which is converted to a DC voltage level in an amplifier 131*a* to provide the threshold reference level for the comparator 130. The comparator 130 outputs a pulse signal on line 130*a* which is high whenever the output of the switch 115 is above the threshold level. This output is applied to a blanking circuit 132, which responds each time the comparator output goes high to blank the signal for a predetermined time period, so that the output of the blanking circuit 132 is a pulse signal ENGSYNC, which is applied to the digital circuits 55.

Basically the ENGSYNC signal is a timing signal which comprises a short pulse responsive to the spike in primary, secondary and fuel injection waveforms at the beginning of each cylinder time period, corresponding in time to the application of the firing voltage to the spark plug. It is desired that there be only a single ENGSYNC pulse for each cylinder. However, the ringing portion of the secondary wave pattern (see FIG. 19) may sometimes have an amplitude sufficient to exceed the threshold level in the comparator 130, which would produce a second pulse for that cylinder. Also, some modern engines intentionally provide multiple firings of each spark plug during each engine cycle to promote better combustion of the fuel, and each such firing will cause an output from the comparator 130. The blanking circuit 132, which may be of the type disclosed in U.S. Pat. No. 4,095,170, ensures that the ENGSYNC signal will include only the first spark plug firing in each cylinder time period, and that any other excursions of the waveform pattern above the threshold of the comparator 130 during that cylinder time period will be ignored.

The 1CYL signal from the inductive pickup lead 31 is applied through conditioning circuitry 138 which outputs a 1SYNC signal to the digital circuits 55. The three sync signals LABSYNC, ENGSYNC and 1SYNC are all fed to the digital circuits 55 via the line 52.

The ID signals from the secondary lead 32 (or the auxiliary lead 36, when used) are applied in parallel to an identification latch 139, to which is also applied the DIPOL signal. The latch 139 has an eight-bit output which is applied over the bus 54 to the digital circuits 55. The latch 139 is controlled by an ANCLKA signal and an −OC4 signal received from the digital circuits 55 (and specifically from FIG. 8) over the line 54*a*. The bus 54, which is bidirectional, also carries switch control data from the digital circuits 55 to the input of a switch control latch 142, which is further controlled by an ANCLKB signal received from the digital circuits 55 over the line 54*a* to produce the switch control signals SWA-SWG for the switches 113-115, 120, 124, 125 and 128. The bus 54 also carries vertical position data from the digital circuits 55 to the input of a D/A converter 141, which outputs an analog VPOS signal to the summing amplifier 129 to vary the vertical position of the waveform.

The output of the latch 139 provides identification signals to the digital circuits 55 so that the latter can identify the particular pickup being used. In the case of DI engines, the DIPOL signal indicates the polarity of the signal to determine whether it is a positive or a negative firing. Armed with this identification information, the digital circuits generate ANCLKA and ANCLKB signals for controlling the latches 139 and 142 and the switch control data for the latch 142 so it can output the appropriate switch control signals.

Digital Circuits

Figure 7:
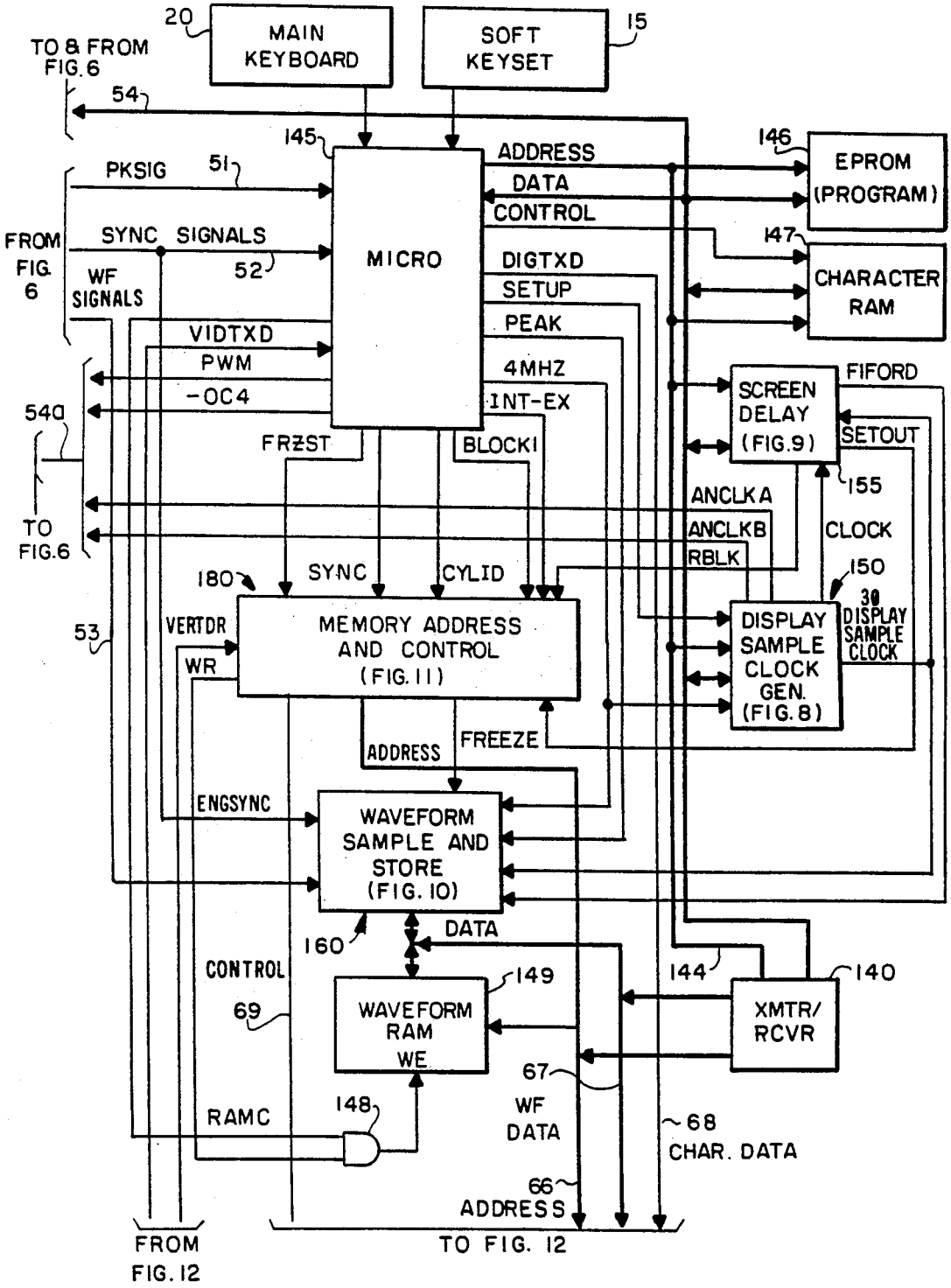
FIG. 7 is a block diagram of the digital circuits of the circuitry of FIG. 4.

The digital circuits 55 are shown in FIG. 7 and their basic functions are to read the main keyboard 20 and the soft key set 15, to control the operations of the analog circuits 50, and to receive and manipulate data from the analog circuits 50. The heart of the digital circuits 55 is a microprocessor 145 which is coupled to the soft key set 15 and to the main keyboard 20. The microprocessor 145 is also coupled to the analog circuits 50, receiving therefrom the PKSIG signal on the line 51, the sync signals on the line 52 and the ID signals on the bus 54. The microprocessor 145 outputs the PWM and −OC4 signals to the analog circuits 50 on the line 54*a*. The microprocessor 145 is also coupled by the bidirectional data bus 54 and by an address bus 144 to a transmitter/-receiver 140, an EPROM 146, a non-volatile character RAM 147, screen delay circuitry 155 and a display sample clock generator 150. Address signals from the microprocessor 145 are transmitted through the transmitter/receiver 140 to the video display circuits 65 via the address bus 66.

A RAMC signal from the microprocessor 145 is applied to one input of an AND gate 148, the output of which is applied to the WE terminal of a non-volatile waveform RAM 149, which receives waveform data from a waveform sample and store circuit 160. That data is also sent to the video display circuits 65 (FIG. 12) via the data bus 67. Address information is transmitted from a memory address and control circuit 180 (FIG. 11) to the waveform RAM 149 and to the video display circuits 65 via the address bus 66. The memory address and control circuit 180 also applies a WR signal to the other input of the AND gate 148, and applies a FREEZE signal to the waveform sample and store circuit 160.

The microprocessor 145 produces a 4 MHz clock signal which is applied to the waveform sample and store circuit 160 and to the display sample clock generator 150, the latter producing a three-phase display sample clock signal which is applied to the screen delay circuitry 155 and to the waveform sample and store circuit 160. The display sample clock generator 150 also generates the ANCLKA and ANCLKB signals, which are sent to the analog circuits 50 via the line 54*a*, and a CLOCK signal, which is sent to the screen delay circuitry 155. The screen delay circuitry 155 generates a SETOUT signal and an RBLK signal, which are applied to the memory address and control circuit 180, and a FIFORD signal which is applied to the waveform sample and store circuit 160. The waveform sample and store circuit 160 also receives from the analog circuits 50 the waveform signals via the line 53 and the ENGSYNC signal, and further receives from the microprocessor 145 a PEAK signal. The microprocessor 145 also sends control signals to the character RAM 147 and a SETUP signal to the display sample clock generator 150.

The memory address and control circuit 180 receives from the microprocessor 145 an INT-EX signal, a BLOCK1 signal, a CYLID signal, a SYNC signal and an FRZST signal. It further receives from the video display circuits 65 a VERTDR signal, and outputs control signals to the video display circuits 65 on the line 69.

Video display information from the video display circuits 65 is applied to the microprocessor 145 as a VIDTXD signal. As was explained above in connection with FIGS. 17–25, the screen displays may include not only waveform data but also alphanumeric or other types of character data. This latter data is sent to the video display circuits 65 via the data bus 68 as a DIGTXD signal.

The EPROM 146 stores the operating program for the microprocessor 145. The character RAM 147 is a non-volatile RAM which receives character data from the microprocessor 145 and stores it at designated addresses. One portion of the RAM 147 acts as a serial buffer. Periodically data is transferred from other portions of the RAM 147 into the serial buffer portion and is read out back to the microprocessor 145, which then transmits the data serially in the DIGTXD signal to the video display circuits 65. In the KV Histograph mode of operation, data is transferred from the character RAM 147 to the waveform RAM 149, and thence to the video display circuits 65 via the transmitter/receiver 140, as will be explained more fully below.

The display sample clock generator 150 generates a display sample clock signal which controls the rate at which samples will be taken from the analog input waveform for display on the monitor screen 12. The waveform sample and store circuit 160 effects the actual sampling of the analog waveform and passes the samples selected for display to the waveform RAM 149 where they are temporarily stored for display, before transfer to the video display circuits 65 via the data bus 67. The address signals for the waveform RAM 149 are generated by the memory address and control circuit 180.

Display Sample Clock Generator

The display sample clock generator 150 is shown in FIG. 8 and includes a port expander and counter 151 which is coupled to the data bus 54 and the address bus 144 and also receives the 4 MHz clock signal from the microprocessor 145. The port expander and counter 151 generates the ANCLKA and ANCLKB signals, and also generates the CLOCK signal, which is applied to the clock input of a flip-flop 152, as well as to the screen delay circuitry 155 of FIG. 9. The Q output of the flip-flop 152 is connected to the 1D input of a quad flip-flop 153 which is clocked by the 4 MHz clock signal. The quad flip-flop 153 has four Q outputs and four −Q outputs. The 1Q output is connected to the 2D input. The −1Q output is connected to the clear terminal of the flip-flop 152. The 2Q output is connected to the 3D input. The SETUP signal from the microprocessor 145 is connected to the clear terminal of the quad flip-flop 153.

Screen Delay Circuitry

Figure 11:
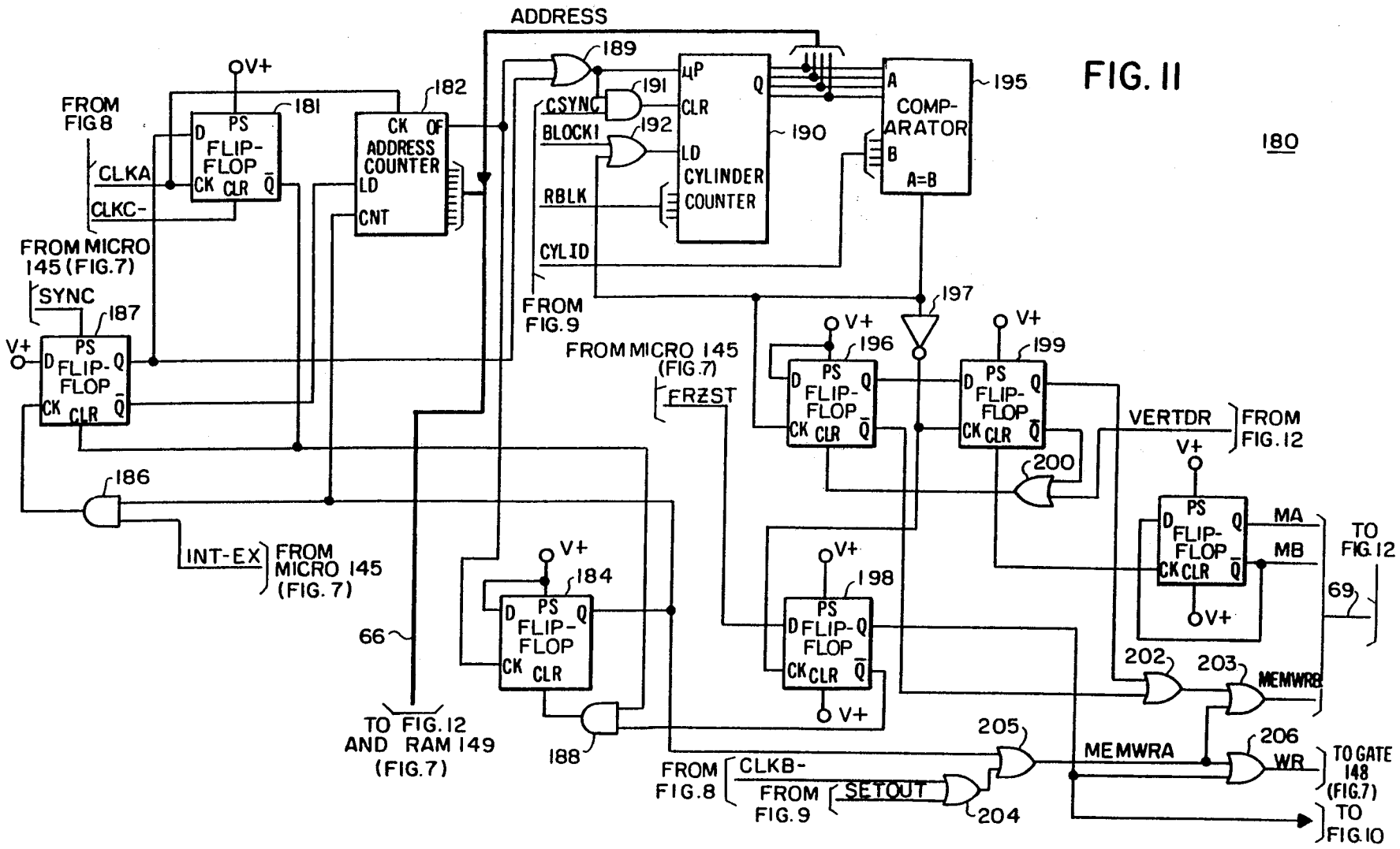
FIG. 11 is a block diagram of the memory address and control circuit of the digital circuits of FIG. 7.

The screen delay circuitry 155 is illustrated in FIG. 9, and includes a port expander and counter 156 which is coupled to the data bus 54 and to the address bus 144 for receiving data and address signals from the microprocessor 145, and also receives the CLOCK signal from the display sample clock generator 150 (FIG. 8) The port expander and counter 156 generates a PEAK signal which is applied to the waveform sample and store circuits 160 (FIG. 10). It also generates the CSYNC, BLOCK1, CYLID and RBLK signals which are applied to the memory address and control circuit 180 (FIG. 11). The port expander and counter 156 also generates a clock signal which it applies to the clock input of a flip-flop 157, the Q output of which is connected to the D input of a flip-flop 158, the clock and preset inputs of which respectively receive the CLKC- and CLKB- signals from the display sample clock generator (FIG. 8). The Q output of the flip-flop 157 also constitutes the SETOUT signal, which is applied to the memory address and control circuit 180 (FIG. 11). The −Q output of the flip-flop 158 is the FIFORD signal, which is applied to the waveform sample and store circuit 160 (FIG. 10).

Waveform Sample and Store Circuit

The waveform sample and store circuit 160 is shown in FIG. 10, and includes an A/D converter 161 which receives the VREF and VIN signals from the analog circuits 50 (FIG. 6). The VREF signal provides a precise voltage reference for the A/D converter 161. This reference level is determined by the microprocessor 145 in the digital circuits 55 (FIG. 7), but the microprocessor 145 does not have the ability to put out an analog voltage. Therefore, it outputs a digital byte to the D/A converter 141 (FIG. 6), which converts that number to an analog voltage level. The A/D converter 161 receives the 4 MHz clock signal and samples the analog waveform signal VIN at a 4 MHZ rate, outputting 8-bit digital samples on the data bus 162 to a latch 163 and to the P input of a magnitude comparator 164. The latch 163 and the Q input of the magnitude comparator 164 are also interconnected by a data bus 166, which is also coupled to a first-in-first-out (FIFO) storage circuit 165. The CLKC-signals from the display sample clock generator 150 (FIG. 8) are coupled to the clear terminal of the latch 163.

The P greater than Q output of the magnitude comparator 164 is applied to the D input of a flip-flop 167, the Q output of which is applied to one input of an OR gate 168. The 4 MHz clock signal is applied to the clock input of the flip-flop 167 and to the other input of the OR gate 168, the output of which is applied to one input of an OR gate 169. The −Q output of the flip-flop 167 is connected to the clock input of the latch 163.

The PEAK signal from the screen delay circuitry 155 (FIG. 9) is applied to the D input of a flip-flop 170, the clock input of which receives the ENGSYNC signal from the analog circuits 50 (FIG. 6). The Q output of the flip-flop 170 is connected to one input of an OR gate 171, the other input of which receives the CLKA- signal from the display sample clock generator 150 (FIG. 8). The output of the OR gate 171 is connected to the clear terminal of the flip-flop 167 and, through an inverter 172, to the other input of the OR gate 169, the output of which is connected to the preset terminal of the flip-flop 167. The Q output of the flip-flop 170 is also connected to the load input of a counter 175, the count up input of which receives the CLKA signal from the display sample clock generator 150 (FIG. 8). The counter 175 has a carry output which is connected to the clear terminal of the flip-flop 170.

The FIFO storage circuit 165 has a write input W which receives the CLKA- signal from the display sample clock generator 150 (FIG. 8), and a read input R which is connected to the output of an OR gate 177, the inputs of which receive the FIFORD signal from the screen delay circuitry 155 (FIG. 9) and the FREEZE signal from the memory address and control circuit 180 (FIG. 11). The output of the FIFO storage circuit 165 is applied via the data bus 67 to the waveform RAM 149 (FIG. 7).

Fundamentally, whatever sample value is stored in the latch 163 is present at the input of the FIFO storage circuit 165, and is written thereinto each time a CLKA- pulse appears, i.e., at the display sample clock rate, which is a rate set to provide 512 display samples during each cylinder period. This rate is much slower than the 4 MHz rate at which the analog waveform signal is being sampled by the A/D converter 161. But this display sample clock rate is more than adequate to accurately reproduce most portions of the analog input waveform. Thus, most of the time, most of the samples from the A/D converter 161 are not needed and only selected ones of them are displayed. But the waveform sample and store circuit 160 is continuously operating to store the maximum sample value which occurs during each cylinder period. Thus, during high frequency portions of the waveform which are too rapid to be accurately captured by the display sample clock rate, the circuitry switches to select the stored peak values for display.

Memory Address and Control Circuit

Figure 12:
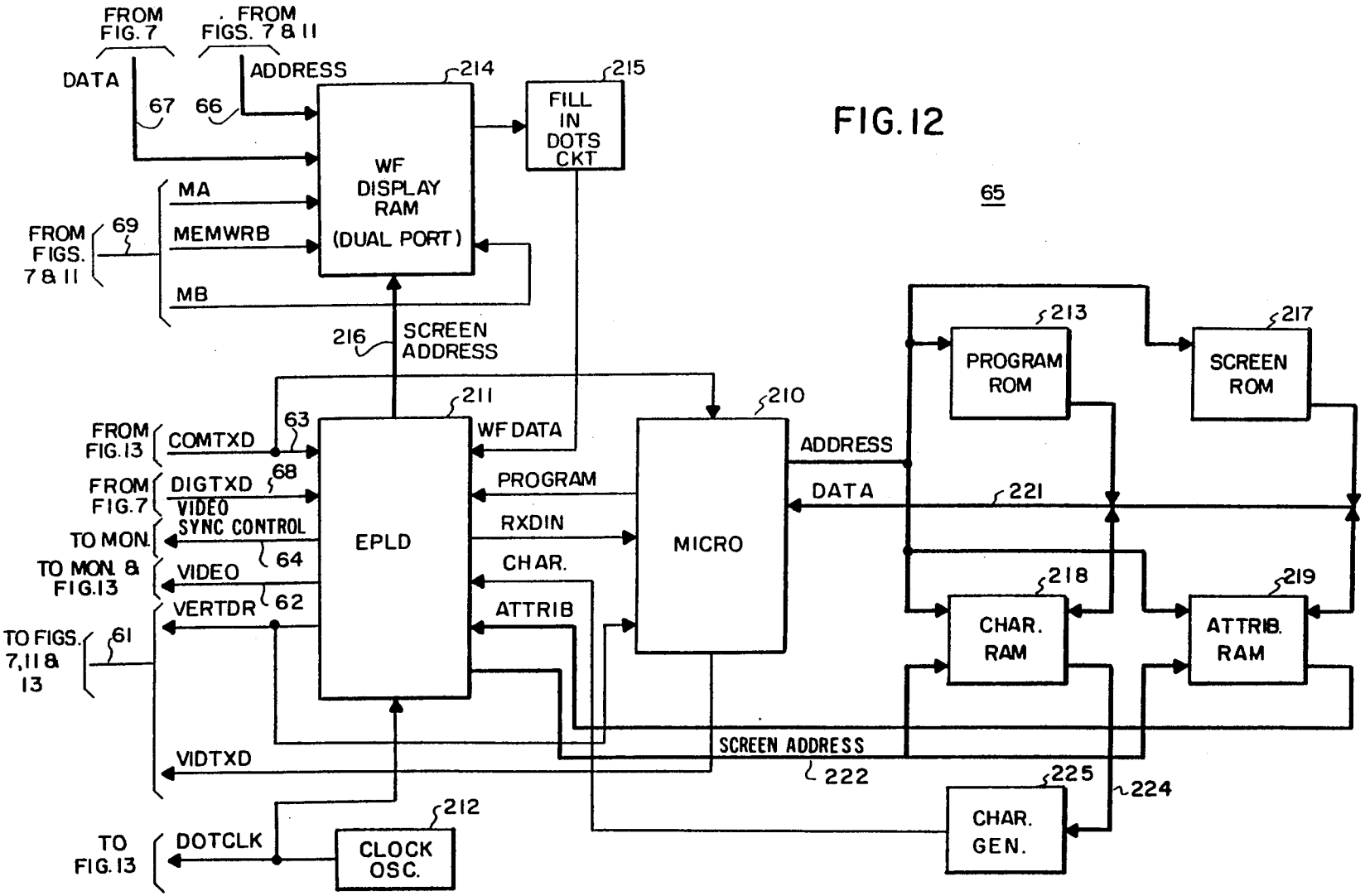
FIG. 12 is a block diagram of the video display circuits of the circuitry of FIG. 4.

The memory address and control circuit 180 is shown in FIG. 11. It basically operates to generate the display address signals and certain control signals for waveform RAM 149 and for waveform display by the video display circuits 65, as well as certain control signals for other portions of the digital circuits 55. A flip-flop 181 receives the CLKA signal at its clock input and the CLKC- signal at its clear terminal. The CLKA signal is also connected to the clock input of an address counter 182, which outputs 9-bit digital address signals on the data bus 66 to the waveform RAM 149 and the video display circuits 65 (FIG. 12). The address counter 182 also has an overflow output which is connected to the clock input of a flip-flop 184, the Q output of which is connected to the count input of the address counter 182 and to one input of an AND gate 185, the other input of which receives the CLKC signal from the display sample clock generator 150 (FIG. 8). The output of the AND gate 185 is connected to one input of an AND gate 186, the other input of which receives the INT-EX signal from the microprocessor 145 (FIG. 7). The output of the AND gate 186 is applied to the clock input of the flip-flop 187, the preset terminal of which receives the SYNC signal from the microprocessor 145 (FIG. 7). The Q output of the flip-flop 187 is connected to the D input of the flip-flop 181 and to one input of an OR gate 189, the other input of which is connected to the overflow output of the address counter 182. The −Q output of the flip-flop 181 is connected to the clear terminal of the flip-flop 187 and to one input of an AND gate 188, the output of which is connected to the clear terminal of the flip-flop 184.

The output of the OR gate 189 is connected to the count up input of a cylinder counter 190 and to one input of an AND gate 191, the other input of which receives the CSYNC signal from the screen delay circuitry 155 (FIG. 9), and the output of which is connected to the clear terminal of the cylinder counter 190. The load terminal of the cylinder counter 190 is connected to the output of an OR gate 192, one input of which receives the BLOCKl signal from the screen delay circuitry 155 (FIG. 9), and the other input of which is connected to the A=B output of a comparator 195. The 4-bit A input of the comparator 195 is connected to the output of the cylinder counter 190, which is also coupled to the address bus 66, while the 4-bit B input of the comparator 195 receives the CYLID signal from the screen delay circuitry 155 (FIG. 9). The cylinder counter 190 also receives a 4-bit RBLK signal from the screen delay circuitry 155 (FIG. 9).

The A=B output of the comparator 195 is also connected to the clock input of a flip-flop 196 and, through an inverter 197, to the clock inputs of flip-flops 198 and 199. The −Q output of the flip-flop 198 is connected to the other input of the AND gate 188. The D input of the flip-flop 198 receives the FRZST signal from the microprocessor 145 (FIG. 7). The −Q output of the flip-flop 199 is connected to one input of an OR gate 200, the other input of which receives the VERTDR signal from the video display circuits 65 (FIG. 12). The output of the OR gate 200 is connected to the clear terminals of the flip-flops 196 and 199 and to the clock input of a flip-flop 201. The Q and −Q terminals of the flip-flop 201 respectively output signals MA and MB which are sent via the line 69 to the video display circuits 65 (FIG. 12). The MB signal is also connected to the input of the flip-flop 201.

The −Q output of the flip-flop 196 and the Q output of the flip-flop 199 are respectively connected to the two inputs of an OR gate 202, the output of which is connected to one input of an OR gate 203. An OR gate 204 has the two inputs thereof respectively connected to receive the CLKB-signal from the display sample clock generator 150 (FIG. 8) and the SETOUT signal from the screen delay circuitry 155 (FIG. 9). The output of the OR gate 204 is connected to one input of an OR gate 205, the other input of which is connected to the Q output of the flip-flop 184. The output of the OR gate 205 is a signal MEMWRA, which is applied to the other input of the OR gate 203 and to one input of an OR gate 206, the other input of which is a FREEZE signal which is received from the Q output of the flip-flop 198. The output of the OR gate 203 is a MEMWRB signal, which is sent via the line 69 to the video display circuits 65 (FIG. 12). The output of the OR gate 206 is the WR signal which is sent to the gate 148 on FIG. 7. The FREEZE signal is also sent to the waveform sample and store circuit 160 (FIG. 10).

Video Display Circuits

The video display circuits 65, illustrated in FIG. 12, generate and control the screen displays on the monitor screen 12. The circuits include a microprocessor 210 and an electronically programmable logic device (EPLD) 211 which cooperate to control the operation of the video display circuits 65. A clock oscillator 212 provides a master clock signal DOTCLK which is applied to the EPLD 211 and to the communication circuits (FIG. 13) via the line 61*a*. The EPLD 211 is programmed by PROGRAM signals from the microprocessor 210 to generate screen address signals which are sent via a data bus 216 to a waveform display RAM 214. The program for operating the microprocessor 210 is stored in a program ROM 213.

Waveform data is fed to the RAM 214 from the digital circuits 55 (FIG. 7) via the data bus 67 and is written into the RAM at addresses designated by address information received from the memory address and control circuits 180 (FIGS. 7 and 11) via the bus 66. The waveform data is read out of the RAM 214 to a fill-in-the-dots circuit 215 which generates data to fill in the spaces between waveform samples on the display screen. This circuit may be of the type disclosed in the aforementioned U.S. Pat. No. 4,800,378. The waveform data is read from the RAM 214 at addresses controlled by the screen address data which is received from the EPLD 211 on the bus 216.

The RAM 214 is a dual port RAM, which is essentially divided into two portions, with the input data being written alternately into the two portions, so that one portion can be read from while the other is being written to. The RAM 214 is enabled by the MEMWRB signal and the switching between the portions is controlled by the MA and MB signals, all received on the line 69 from the memory address and control circuit 180 (FIGS. 7 and 11). The waveform data from the fill-in-the-dots circuit 215 is read serially into the EPLD 211 for transfer to the monitor screen 12 and to the communication circuits 60 (FIG. 13) in the VIDEO signal on line 62.

Character data can be received either from the digital circuits 55 (FIG. 7) in the DIGTXD signal on line 68, being then transferred to the microprocessor 210 in the RXDIN signal, or from the communication circuits 60 (FIG. 13) in the COMTXD signal on line 63, which is also input to the microprocessor 210. Character data may also be obtained from a screen ROM 217 which stores format information for the various screen displays, such as titles, headings, instructional text and the like, this information being read by the microprocessor 210. Information is read from the ROMS 213 and 217 under the control of address signals from the microprocessor 210 via a bus 220, the data being read out on the bus 221.

The microprocessor 210 determines where the character information is to be displayed on the screen and the attributes with which it is to be displayed, such as whether it is to be in inverse video, flashing, single or double height or width, and the intensity and color of its display, as well as whether it is to override waveform data appearing at the same screen location. The character data is fed to a character RAM 218 and the attribute data is fed to an attribute RAM 219 over the data bus 221, to be written into those RAMS at addresses determined by address information o the bus 220. The character and attribute information is read from the RAMs 218 and 219 for display at screen addresses determined by address data generated by the EPLD 211 on a bus 222. The attribute data is sent directly to the EPLD 211 on a bus 223, while the character data is sent via a bus 224 to a character generator 225, which assembles the bit pattern for each character and transmits the information serially to the EPLD 211. The EPLD 211 determines whether or not the character data, at any screen location, is to override waveform data and outputs the character and attribute data to the monitor or to the communication circuits 60 (FIG. 13) in the VIDEO signal.

The EPLD 211 also generates the video sync control signals which are applied to the monitor screen 12 via the line 64. The microprocessor 210 generates a VIDTXD signal which contains video data which is transmitted to the digital circuits 55 (FIG. 7) and to the communication circuits 60 (FIG. 13) on the line 61.

Communication Circuits

Figure 13:
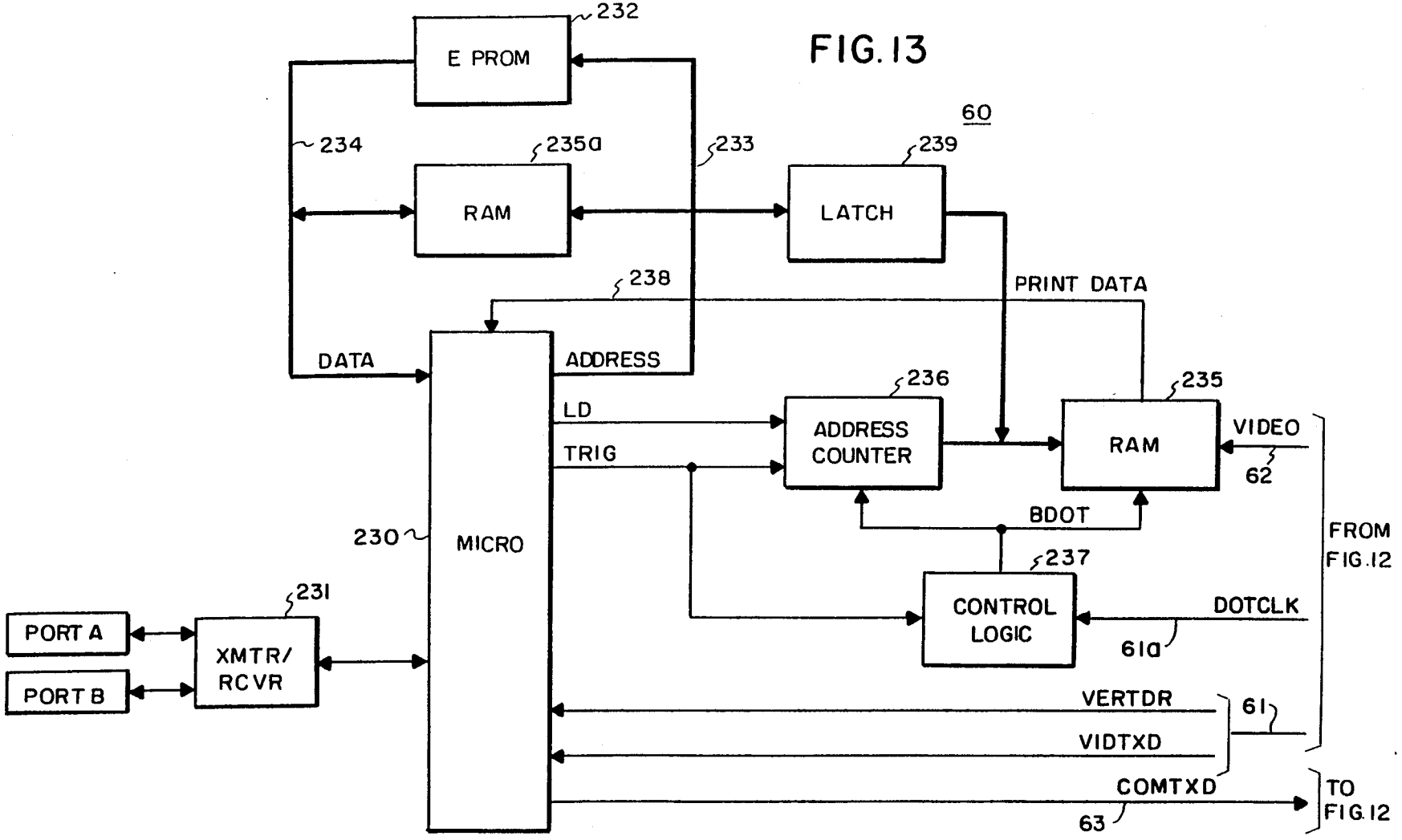
FIG. 13 is a block diagram of the communication circuits of the circuitry of FIG. 4.

The communication circuits 60 are shown in FIG. 13 and operate to provide an interface between peripheral devices, such as a scanner or a printer, and the monitor 12, the digital circuits 55 and the video display circuits 65. The communication circuits 60 include a microprocessor 230, which is coupled to the ports A and B by a transmitter/receiver 231, which is essentially a level translator. The program for the microprocessor 230 is stored in an EPROM 232 which is addressed by the microprocessor 230 via a bus 233, the program data being sent to the microprocessor 230 over a data bus 234.

The VIDEO screen data from the video display circuits 65 (FIG. 12) are stored in a RAM 235, being written thereinto at addresses generated by an address counter 236, which receives control LD and TRIG signals from the microprocessor 230. The TRIG signal is also applied to control logic 237, which also receives the DOTCLK signal from the video display circuits 65 (FIG. 12) via the line 61*a* and generates BDOT signals for controlling the clock rate of the address counter 236 and the RAM 235. Data to be printed is read out from the RAM 235 to the microprocessor 230 over a line 238 under the control of address signals generated by the microprocessor 230 and applied to the RAM 235 through a latch 239. The microprocessor 230 also receives the VERTDR signal and the VIDTXD signal from the video display circuits 65 (FIG. 12) on line 61 and outputs a COMTXD signal on the line 63 to the video display circuits 65.

Operation

Assuming that the analyzer 10 (FIG. 1) has not previously been used, upon power up the start-up display of FIG. 17 will appear on the monitor screen 12. The first thing that the user must do is enter information regarding the engine to be tested, which he does by pressing the soft key F1 to call up the data entry screens as explained above. The user can then, by pressing the OPTION MENU key 25, call up the option menu screen display of FIG. 24, which permits him to access the Scope Setup screen display of FIG. 25, which permits him to program in information concerning what type of equipment, if any, is connected to each of the ports A and B (FIG. 4).

The microprocessor 145 in the digital circuits 55 (FIG. 7) monitors the key strokes used to enter all of this information, and stores the information in the non-volatile character RAM 147. The information is also transferred in the DIGTXD signal over line 68 to the EPLD 211 and thence to the microprocessor 210 in the video display circuits 65 (FIG. 12), and thence in the VIDTXD signal on line 61 to the microprocessor 230 in the communication circuits 60 (FIG. 13). Each of the microprocessors 210 and 230 has sufficient internal RAM to store this setup information. This information will be used by all of the microprocessors to tailor each of the display screens to the particular type of engine being tested, and to tailor the scanner interface mode of operation to the particular type of scanner connected. Because the character RAM 147 is non-volatile, it will retain all of the setup information when the analyzer 10 is powered down. Thus, when it is again powered up, the microprocessor 145 will reinitialize itself in accordance with the saved setup information, and will accordingly initialize the microprocessors 210 and 230.

All waveform data is obtained from the lead set 30, processed in the analog circuits 50, digitized in the digital circuits 55 and arranged in the video display circuits 65 for display on the monitor screen 12. The particular waveform display and the format of the display are determined by the user via selections made with the soft key set 15 and the main keyboard 20. In the illustrated embodiment, any one of five different waveform inputs might be displayed, viz., the VOLTLD signal from the alternator/battery lead 34, the PRIM signal from the primary/fuel injection lead 33, and any one of the three possible secondary signals ALTSEC, MAINSEC and HIGHSEC from the secondary lead 32. Each of these signals is applied, after conditioning, to the signal select switch 114 and to the sync select switch 115. It will be appreciated that, if desired, additional waveform signals could also be detected and applied to the switches 114 and 115. For example, pickups or probes could be connected to the auxiliary lead 36 to provide associated input signals (not shown). The switch 114 selects the input signal to be displayed on the screen, while the switch 115 selects the signal which is to serve as the sync source.

Thus, it will be appreciated that the engine analyzer 10 permits the display of one signal while syncing off another signal. The microprocessor 145 in the digital circuits 55 is programmed so that, as it goes into each waveform mode of operation, it selects the appropriate sync source to operate from. Sometimes this is variable. For example, if a secondary signal is being displayed, it would normally be preferable to work with a secondary sync signal. However, if the microprocessor determines that the secondary sync signal is not stable, or is completely missing, it can switch over to the primary sync signal. But on some newer cars a primary sync signal is not accessible, in which case the microprocessor would switch back to the secondary sync signal.

The engine analyzer 10 is also capable of operation in a labscope mode in which the operator can choose among the labscope input itself, or the primary, secondary or number 1 cylinder signals for use as a sync source or, alternatively the analyzer 10 can use no sync signal at all and simply run on a time base.

The switches 113 and 120 are utilized for DI engines, which require two secondary inputs, viz., ALTSEC and MAINSEC. In this event, each coil is connected to two different spark plugs so that each time that the coil outputs a firing voltage it fires both spark plugs, and it does this twice during each engine cycle. Thus, for each firing, one of the plugs being fired is a "true" firing in the compression stroke, while the other is a "wasted" firing in the exhaust stroke. Switch 113 is constantly switching under the control of the signal SWA, which is in turn generated under the control of the microprocessor 145, to select the "true" one of the two secondary inputs.

Furthermore, during each engine cycle, half of the "true" firings will be positive and half will be negative. Thus, both inverted and non-inverted forms of the selected output from the signal select switch 114 are applied to the switch 120, which is continually switching under the control of the SWD signal for selecting between the inverted and non-inverted forms of the waveform, so that the screen display will always be positive.

The microprocessor 145 (FIG. 7) is able to make the switching decisions because it knows the nature and polarity of the input waveform signals from the ID and DIPOL signals applied to the identification latch 139 (FIG. 6). Furthermore, from this information the microprocessor also knows to have the sync select switch 115 select the DISYNC sync source instead of using the normal secondary sync that would be used for a conventional ignition.

The sync source selected by the switch 115 is applied to the comparator 130 for generating the ENGSYNC signal. More specifically, referring to FIG. 14, the analog waveform signal is illustrated in waveform A, in this case a secondary voltage pattern 80. That signal is compared in the comparator 130 with a threshold level 241, the output of the comparator 130 going high when the analog sync signal exceeds the threshold level 241, and returning low when it drops back below the threshold level. The blanking circuit 132 blanks out the output of the comparator 130 a very short time after it goes high and for the remainder of the cylinder period to produce a short pulse 242 as the ENGSYNC signal and to ensure that there will be no further ENGSYNC pulses during that cylinder period, as was explained above in connection with FIG. 6.

Character information to be displayed on the monitor screen 12 may come from any of a number of sources, viz.: (a) the lead set 30, which provides voltage level information, such as for the KV histograph, and timing information, such as for the cylinder time balance and spark plug burn time analyses; (b) from the main keyboard 20, such as engine information keyed in by the user; (c) from the screen ROM 217 (FIG. 12), which provides background formats for the various screen displays; and (d) from an associated scanner via the communication circuits 60 (FIG. 13).

In the case of voltage level signals from the lead set 30, the waveform signals are selected by the switch 125 and applied to the peak hold circuits 126 and 127. For DI engines there are two input waveforms, which include both positive and negative polarity signals. Thus, they are both first passed through the absolute value amplifiers 111 to provide positive going outputs, and the switch 125 passes both signals respectively to the peak hold circuits 126 and 127. The switch 128 selects only one of these peak signals for display at any given time. In the case of a standard ignition, the switch 125 selects the KVIN signal from the switches 114 and 120, and directs it to the peak hold circuit 127, the output of which is passed by the switch 128. The output of the switch 128 is the KVOUT signal, which is passed by the switch 124 as the PKSIG signal. The KVIN signal is also applied directly to the switch 124, which passes it as the SELSIG signal, which is in turn fed back to the input of the switch 115 so it is available for selection as a sync source.

Figure 14:
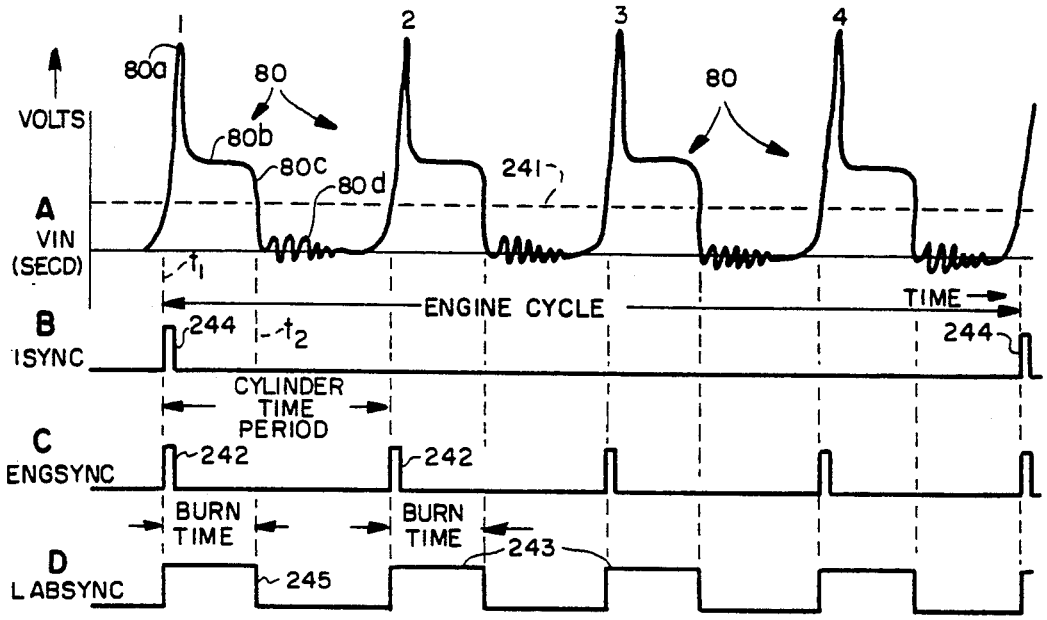
FIG. 14 is a timing diagram illustrating the time relationship signals at various points of the circuits shown in FIG. 6.

The KVIN signal is also compared in the comparator 123 to a threshold level which, for purposes of illustration will be assumed to be substantially the same as the level 241 (FIG. 14). When it exceeds this threshold the output of the comparator 123 goes high to form the BRNT signal, which is passed by the switch 124 as the LABSYNC pulse signals 243, illustrated in waveform D of FIG. 14, which return low at 245 when the waveform voltage drops back below the threshold level 241.

The 1CYL signal is passed through conditioning circuitry 138, which includes a fairly low threshold level which, for convenience, is again assumed to be the same as the threshold level 241 in FIG. 14. The conditioning circuitry 138 includes a multivibrator which produces an output 1SYNC signal, illustrated in waveform B of FIG. 14, which comprises a short pulse 244 each time the firing voltage is applied to the number 1 cylinder.

All of the information from the analog circuits is passed to the digital circuits 55 (FIG. 7). The waveform signals, which include the analog waveform signal VIN and the reference signal VREF, are applied to the waveform sample and store circuit 160, which digitizes the VIN signal for display. This digitizing operation occurs under the control of display sample clock signals from the display sample clock generator 150, which control the rate at which the samples are selected for display, and signals from the screen delay circuitry 155, which control the horizontal positioning of the waveform on the screen. The waveform display samples are stored in the waveform RAM 149 at addresses determined by an address counter in the memory address and control circuit 180, for use in the FREEZE function, described hereinafter. The display samples are also passed via the data bus 67 to the waveform display RAM 214 of the video display circuits 65 (FIG. 12), where they are stored at addresses generated by the memory address and control circuit 180 and passed over the address bus 66.

Referring to FIG. 11, the memory address and control circuit 180 provides addresses to the waveform RAMs 149 (FIG. 7) and 214 (FIG. 12) so the data can be written into them in blocks corresponding to engine cylinders in order to permit display of information with respect to a single selected cylinder. Within each such block there are 512 address locations permitting storage of 512 bytes of information corresponding to 512 waveform samples, the maximum number of samples which can be simultaneously displayed on the screen. The address counter 182 counts the number of address locations in each block, and a cylinder counter 190 counts the number of cylinders or storage blocks.

The microprocessor 145 (FIG. 7) provides an INT-EX signal that selects between external and internal sync. The address counter 182 counts from zero, and in the case of an external sync, it is desired that it reach a count of 511 simultaneously with the occurrence of the sync pulse. In the case of external sync, the INT-EX signal is low, so that the output of the AND gate 186 is held low. In this case, the microprocessor 145 provides a SYNC pulse in response to each ENGSYNC pulse from the analog circuits 50. This SYNC pulse causes the Q output of the flip-flop 187 to go high, while its −Q output goes low, loading the address counter 182 to a count of zero, so that it can start counting the display sample clock pulses CLKA. On the occurrence of the next one of the CLKA pulses, the −Q output of the flip-flop 181 goes low, clearing the flip-flop 187 and the flip-flop 184. The corresponding CLKC- pulse which occurs 250 nanoseconds later, clears the flip-flop 181. The incoming SYNC signal, the display sample clock pulses and the address counter 182 are now synchronized, and the address counter 182 proceeds to count the display sample clock pulses, producing for each one an 9-bit address signal which is fed to the waveform RAMs 149 and 214 via the bus 66. In the event that the operator has selected a parade pattern display of the waveforms for the several cylinders, the microprocessor 145 will cause a SYNC pulse to be generated only once during each engine cycle.

If the input waveform frequency is changing, it is possible that the display sample clock generator 150 (FIG. 8) may be running too fast or too slow. If it is too slow, the address count by the address counter 182 will not be up to 511 by the time the next SYNC pulse occurs. This can be prevented by updating the display sample clock rate more frequently, and by using an adaptive frequency slope routine in calculating the display sample clock rate. If the display sample clock generator is too fast, the address counter 182 will reach a count of 511 before the occurrence of the next SYNC pulse. In this case, the overflow output OF of the address counter 182 will go high and clock the flip-flop 184, causing its Q output to go high to stop the counting of the address counter 182. Upon the occurrence of the next CLKA pulse, when the −Q output of the flip-flop 181 goes low, it will clear the flip-flop 184, thereby permitting the address counter 182 to begin counting again upon the occurrence of the next SYNC pulse for the next cylinder.

The address signals from the address counter are applied to the waveform RAMs 149 and 214 under the control of write pulses WR and MEMWRB, respectively, which follow the CLKB- display sample clock pulses. More specifically, since the SETOUT signal from the screen delay circuitry 155 (FIG. 9) is normally low, the output of the OR gate 204 follows the CLKB- pulses, which are in turn passed through the OR gate 205 as MEMWRA pulses, since the other input to the OR gate 205 is normally low. The MEMWRA pulses in turn pass the OR gate 203 as the MEMWRB signal and pass the OR gate 206 as the WR signal, since the other inputs to these gates are normally low, as long as the count of the cylinder counter 190 corresponds with the selected cylinder. When the address counter 182 overflows, clocking the flip-flop 184, the high at its Q output holds the output of the OR gate 205 high, thereby blocking the write pulse trains MEMWRB and WR, preventing any more addresses from being written into that block of the waveform RAMs 149 and 214.

In the case of an internal sync, there is no SYNC pulse to toggle the flip-flop 187, so it is toggled each time the address counter 182 overflows, i.e., reaches a count of 512. More specifically, the INT-EX signal is high, so that the output of the AND gate 186 follows the output of the flip-flop 184. When the address counter 182 reaches a count of 512, its overflow output causes the Q output of the flip-flop 184 to go high, clocking the flip-flop 187 and toggling it just as if a SYNC pulse had occurred. Thus, the address counter 182 is free running.

Each time the flip-flop 187 is toggled, or each time the address counter 182 overflows, the cylinder counter 190 is incremented through the OR gate 189 to the next cylinder or storage block. The count of the cylinder counter 190 is output in a 4-bit signal to the A input of the comparator 195, and when that count corresponds to the number of the cylinder which the user has selected for display, as indicated by the CYLID 4-bit signal applied to the B input, the A=B output of the comparator 195 goes high, clocking the flip-flop 196 and causing its −Q output to go low, thereby holding the output of the OR gate 202 low for the duration of the selected cylinder time period, allowing the MEMWRB write pulses to pass the OR gate 203. The next time the cylinder counter 190 is incremented, there will no longer be a match in the comparator 195, so that the A=B Output will return low, thereby returning the −Q output of the flip-flop 196 high and blocking the write pulses from passing the OR gate 203.

Each time the A=B output of the comparator 195 returns low at the end of the selected cylinder time period, it clocks the flip-flop 199, causing its −Q output to go low to clear the flip-flops 196 and 199. Upon the occurrence of the next selected cylinder time period, when the A=B output of the comparator 195 goes high the −Q output of the flip-flop 199 returns high, clocking the flip-flop 201 and causing its Q output to go high to produce the MA signal. At the end of the selected cylinder time period, the Q output of the flip-flop 201 goes low while its −Q output goes high, to produce the MB signal. The MA and MB signals are applied to the waveform display RAM 214, which is a dual port RAM, for switching between the ports. Thus, during the selected cylinder time period the waveform data for that cylinder is written into one portion of the display waveform RAM 214 and, at the end of the selected cylinder time period, the display waveform RAM 214 is switched so that the section just written to becomes the read section and the section that was being read from becomes the write section which will be written to the next time the selected cylinder becomes active.

The output of the flip-flops 196 and 199 is synchronized with the VERTDR signal, which is the vertical sync pulse of the oscilloscope, and which occurs 60 times per second. Thus, the flip-flop 201 will be clocked at the end of each selected cylinder time period, but only once during any vertical drive cycle. This ensures that only 60 waveforms per second will be displayed, since if more than 60 waveforms per second were to occur the displayed waveform would appear broken up.

In order to synchronize the cylinder counter 190 with the correct cylinder of the engine, the microprocessor 145 outputs the CSYNC signal each time the number 1 cylinder is fired, thereby clearing the cylinder counter 190 to zero so that it corresponds with the software cylinder counter.

Whenever the user operates the FREEZE function key 23 to freeze the screen display, this initiates a modified internal sync operation. The external SYNC signal is disabled and the address counter 182 free runs, resetting itself at a count of 512. In order to prevent the possibility of freezing a waveform in the middle of a display, the microprocessor sets the FRZST signal high. Thus, when the output of the comparator 195 goes from a high to a low at the end of a selected cylinder time period, the flip-flop 198 is clocked, setting the FREEZE signal high to block the output of the WR write pulses. This synchronizes the FREEZE signal with the changing of the memory address sections.

During certain modes of operation such as parade patterns, labscope operation, vacuum, voltmeter, fuel injection or alternator modes, there is only a single waveform to be captured; in this case, only a single block in the waveform RAMs 149 and 214 need be addressed, and this address is provided to the cylinder counter 190 in the RBLK signal from the port expander and counter 156 (FIG. 9). This address is passed directly to the address bus 66, and the cylinder counter 190 output will match the RBLK value. In these single waveform modes of operation a means of ensuring that the waveform display RAM 214 gets switched is needed. This is accomplished by the microprocessor 145 setting the CYLID signal to the desired waveform RAM address, and setting the BLOCK1 signal low. Since the RBLK value now matches the CYLID value, the A=B output of the comparator 195 will go high, and the A=B output will go low as soon as the cylinder counter gets incremented by the next SYNC pulse. This now loads the cylinder counter 190 back to the RBLK value through the OR gate 192. The change of the A=B output also clocks the flip-flop 201, as described above. Thus, the waveform display RAM 214 will switch ports with each SYNC pulse.

The sync signals, which include LABSYNC, ENGSYNC and 1SYNC, and the voltage level signals, including the PKSIG signal, are applied directly to the microprocessor 145, which digitizes the analog voltage level signals and performs calculations and other operations on the signals, depending upon the mode of operation selected from the main keyboard 20, to generate the necessary character data for display. This character data, along with that from the main keyboard 20 and the soft key set 15, are then temporarily stored in the character RAM 147 and ultimately passed to the video display circuits 65 in the DIGTXD signal via the line 68.

As was explained above, the microprocessor 145 also receives ID signals on the line 54 and utilizes them to generate control signals which are sent via the line 54 to the analog circuits 50 for controlling the switching functions thereof in cooperation with the ANCLKA and ANCLKB signals from the sample clock generator 150.

Referring to FIGS. 12 and 13, when the character data is being received from a scanner, it passes directly from the communication circuits 60 to the video display circuits 65 in the COMTXD signal on line 63, without passing through the digital circuits 55. In this event, the digital circuits 55 are used only for monitoring the soft key set 15 and the main keyboard 20.

In the video display circuits 65 the waveform data is read out of the waveform display RAM 214 (FIG. 12), at a rate completely independent of the rate at which it is written therein, under the control of the screen address signals on the bus 216 from the EPLD 211. This waveform data is first applied to the fill-in-the-dots circuit 215 which provides a substantially continuous trace between waveform sample values, the waveform data then being passed back to the EPLD 211, which sends it to the monitor screen 12 in the VIDEO signal via line 62.

The character data received from the digital circuits 55 in the DIGTXD signal on line 68 is applied to the EPLD 211, which sends it as RXDIN to the microprocessor 210. Similarly, the character information from the scanner is received by the microprocessor 210 and the EPLD 211 in the COMTXD signal on the line 63. The character data includes information as to the nature of each character and as to its attributes for display. The microprocessor 210 assembles this data, along with that from the screen ROM 217, and stores it in the character RAM 218 and the attribute RAM 219 via the data bus 221 at addresses determined by address signals generated by the microprocessor 210 and sent over the address bus 220. The EPLD 211 then reads the data from the RAMS 218 and 219 under the control of screen address signals generated by the EPLD 211. This character information is then passed to the monitor screen 12 and/or to the communication circuits 60 (for printing) in the VIDEO signal. Portions of the character data may also be sent by the microprocessor 210 to the communication circuits 60 (FIG. 13) in the VIDTXD signal, to be passed to an associated scanner for control thereof.

Referring to FIG. 13, it will be appreciated that the VIDEO signal includes all of the information which is to be displayed on the screen, including both waveform and character information. All of this information can be printed on an associated printer coupled to one of the ports A or B by the user actuating the PRINT function key 23. When this occurs, a signal will be sent to the microprocessor 230 in the VIDTXD signal causing it to generate an LD signal and a TRIG signal to initialize the address counter 236 and the control logic 237. The LD signal causes the address counter 236 to load to a zero count. The TRIG signal occurs during the vertical blanking period of the monitor screen 12, in response to the VERTDR signal from the video display circuits 65 (FIG. 12). Thus, at the end of the vertical blanking period the address counter 236 will start counting to generate address locations in the RAM 235 corresponding to each row on the screen and each raster location on each row, under the control of a BDOT clock pulse generated by the control logic 237 in response to the DOTCLK clock signal from the video display circuits 65 (FIG. 12). Thus, the RAM 235 captures all of the information on the screen at the time the PRINT key is pressed.

In due course the microprocessor 230 then generates address signals on the bus 233 which are applied via the latch 239 to the RAM 235 for reading the data therefrom for passage via the transmitter/receiver 231 to the associated printer. In the event that the data is read from the RAM 235 at a rate faster than it can be printed, it is temporarily stored in the RAM 235*a*, which serves as buffer storage.

Burn Time Bar Graph

The ENGSYNC signal is applied to the microprocessor 145 of the digital circuits 55 on line 52 at a high-speed input, which automatically notes the time of the leading edge of the ENGSYNC pulse 242 (see FIG. 14, waveform C) relative to a free-running, 16-bit timer internal to the chip. When the microprocessor 145 receives the ENGSYNC pulse 242 its program goes into an interrupt service routine to increment a software cylinder counter to a count which corresponds to the number of the cylinder that the program believes to be currently active. This count may or may not correspond to the actual firing order. For example, in the case of a four-cylinder engine, it has a 25% chance of being correct. But the microprocessor 145 also receives the 1SYNC signal once each engine cycle (see FIG. 14, waveform B), which indicates the firing of the cylinder which the operator has designated as the number 1 cylinder. The microprocessor then resets the soft cylinder counter so it has a value of 1 and, from that point on, it should stay in sync with the actual firing order set by the operator but, in any event, it will be reset each time the 1SYNC pulse arrives. It will be appreciated that the rpm of the engine can readily be determined from either the 1SYNC signal or the ENGSYNC signal.

As was indicated above, the threshold level 241 of the comparator 130 (FIG. 6), which is set by the flip-flop 131 and the amplifier 131*a*, is above the amplitude of the ringing portion 80*d* of the input waveform, which is therefore cut off in the comparator 130. Thus, the output of the comparator 130 is a square wave which has a duration substantially equal to the burn time of the spark plug. The leading edge of that signal at time $t_1$ (FIG. 14) indicates the beginning of the burn time. The blanking circuit 132 cuts off the ENGSYNC signal a very short time later. But this is unimportant since it is only the leading edge of the signal which is used.

The end of the burn time is determined by the LABSYNC signal, which is a square wave having a duration very nearly the same as the spark plug burn time (FIG. 14, waveform D). The microprocessor 145 notes the time $t_2$ of occurrence of the trailing edge 245 of the LABSYNC signal. It then subtracts the time $t_1$ from the time $t_2$ to determine the turn time. This information is then stored in digital form in the character RAM 147.

The character RAM 147 is a relatively large RAM and is used for a number of purposes. In the burn time bar graph mode of operation, the microprocessor 145 partitions a portion of the RAM 147 into three tables, with each table having a location for each cylinder of the engine. One table is for the "live" or most recent value of the burn time, one table is for the maximum value and one table is for the minimum value. As each cylinder fires, its burn time value is stored in the appropriate location of the live table. This table is continually updated each engine cycle. At some point, such as when this mode is entered or when the operator presses the CLEAR button, the microprocessor 145 notes the next burn time value for each cylinder and stores it in the maximum and minimum tables as a starting point. Thereafter, each new burn time value, in addition to being stored in the live table, is compared in the microprocessor 145 with the values stored for that cylinder in the maximum and minimum tables. If it is greater than the stored value in the maximum table it replaces that value, and if it is less than the value stored in the minimum table it replaces that value.

Another portion of the character RAM 147 is used as a serial buffer. Periodically, e.g., every eighth of a second, the microprocessor 145 will transfer the data from the three tables to the serial buffer area. The microprocessor 145 then reads the data from the serial buffer one byte at a time and transfers it to the video display circuits 65 in the DIGTXD signal via the line 68, all in response to CONTROL signals.

The data enters the EPLD 211 (FIG. 12) and is sent in the RXDIN signal to the microprocessor 210, which then sends it to the character and attribute RAMS 218 and 219, from which it is read to the monitor screen 12 as explained above for generating the screen display of FIG. 20, in which the live burn times for each cylinder are listed in numerical form at 87 and in bar graph form at 88.

The minimum and maximum tables permit the capturing of misfires or other aberrations in the cylinder firing. Most of the time the burn time value is very stable, but once in a while a particular cylinder may stumble or misfire, in which case its burn time will almost certainly be different from its normal value. This may be only a momentary occurrence, so that the operator could miss it with a blink of an eye. The maximum and minimum tables permit such an aberrant burn time value to be captured and displayed on the screen.

The screen display of FIG. 20 includes an rpm display at 83. This rpm information is stored at another portion of the character RAM 147 and is transferred to the video display circuits 65 in the same data group along with the burn time information.

KV Histograph

The microprocessor 145 (FIG. 7) causes the switch 125 (FIG. 6) to pass the KVIN signal to the peak hold circuit 127 just before a spike 80*a* in the waveform signal is to occur. After the spike has occurred, the switch 128 passes the captured peak from the peak hold circuit 127 to the switch 124 as the KVOUT signal which is, in turn, passed to the microprocessor 145 (FIG. 7) as the PKSIG signal on line 51. The microprocessor 145 includes an A/D converter which digitizes the analog voltage level signal PKSIG and generates a digital representation of the KV value and stores it in the character RAM 147.

More specifically, the microprocessor 145 assigns a separate 256-byte block of storage in the character RAM 147 for each cylinder. As each cylinder is fired, the peak voltage value for that cylinder is stored in the appropriate storage block in the character RAM 147. Each block can store 256 values, i.e., the peak KV values for each cylinder for 256 consecutive engine cycles. Thereafter, each block will be continuously updated, with each new value replacing the oldest value. Thus, the cylinder storage block in the character RAM 147 always holds the KV peak values for the most recent 256 firings of that cylinder.

In the KV histograph mode of operation, the user will select a single cylinder for display, using the main keyboard 20, the number of the selected cylinder being highlighted in the cylinder identification area 92, as illustrated in FIG. 21. Periodically, (e.g., every one sixteenth of a second), the microprocessor 145 causes the entire contents of the selected cylinder block to be copied from the character RAM 147 into a predetermined area of the waveform RAM 149 via the data bus 54 and the transmitter/receiver 140. The data is then transferred from the waveform RAM 149 to the waveform display RAM 214 of the video display circuits 65 (FIG. 12) via the data bus 67. The data is written into the RAMS 149 and 214 at addresses controlled by the address signals from the memory address and control circuit 180 via the address bus 66.

Each KV sample value is written twice into the waveform display RAM 214, so that when it appears on the screen it will be two dots wide. The waveform display RAM 214 is then addressed by signals on the bus 216 from the EPLD 211 (FIG. 12) for reading the data out through the fill-in-the-dots circuit 215 and the EPLD 211 to the monitor screen 12 in the VIDEO signal. This results in the histograph 93 of FIG. 21 being displayed on the screen. The vertical lines between the sample values are generated by the fill-in-the-dots circuit 215.

In the histograph 93 the latest information appears at the right-hand side of the screen, while the oldest information leaves the left-hand end of the screen. Thus, the histograph will appear over time to be scrolling to the left. Occasionally, the KV value for the cylinder may be of a given value for only a single engine cycle, such as at 94. The fact that this value is displayed twice, making the pulse 94 two dots wide, makes it easier to see on the screen. At locations such as 94*a*, of longer horizontal extent, the KV value has stayed the same over a number of consecutive engine cycles.

It will be noted that while, technically, the histograph 93 is the graphical representation of a number of pieces of character information, it has the appearance of a waveform and, therefore, the engine analyzer 10 treats it as a waveform. It is for this reason that the data is passed through the waveform ram 149 and the waveform display ram 214. Otherwise, it could not take advantage of the fill-in-the-dots circuit 215. This would result in the several horizontal portions of the histograph not being connected, making it much more difficult to read and understand. It will be appreciated that, if desired, other character data such as rpm and burn time could be graphed in the same way.

It will be noted that the screen display of FIG. 21 includes a representation of the engine rpm at 91. This rpm data is handled in the same way as was described above for the spark plug burn time mode of operation in connection with FIG. 20. Thus, the rpm data is read out of the character RAM 147 by the microprocessor 145 (FIG. 7) and transferred to the video display circuits 65 of FIG. 12 in the DIGTXD signal over line 68.

Cylinder Time Balance

As was explained above, with each application of firing voltage to a cylinder, an ENGSYNC pulse 242 is generated (FIG. 14), and the microprocessor 145 (FIG. 7) precisely marks the time of occurrence of the leading edge of such pulse. The cylinder time period for a cylinder is the time between the occurrence of the ENGSYNC pulse for that cylinder and the occurrence of the ENGSYNC pulse for the next cylinder in the firing order. The microprocessor 145 calculates this cylinder time period by subtracting the time of occurrence of the first pulse from the time of occurrence of the second one, and it does this repeatedly for each cylinder. The digital representations of the cylinder time period values are stored in the character RAM 147. More specifically, the microprocessor 145 partitions a section of the character RAM 147 into a number of tables, with one table for each cylinder. As each cylinder time period value is calculated, that value is stored in the appropriate table. Each cylinder table can store ten cylinder time period values, i.e., the values for ten consecutive engine cycles. When the table is full, each new cylinder time period value for a cylinder replaces the oldest value in that table.

Each time a value is added to the table for a particular cylinder, the microprocessor calculates an average of all of the values stored in that table, and stores this cylinder average in another table, which contains the cylinder averages for each of the cylinders. With each cylinder firing, the microprocessor 145 also calculates the overall average of the values stored in the cylinder average table, and then stores that overall average value. The microprocessor 145 then compares each cylinder average with the overall average, finds the difference and divides it by the overall average to obtain a percentage difference figure, which can be either positive or negative. The percentage difference value for each cylinder is then stored in a separate table.

Periodically, typically 8 times a second, the microprocessor 145 transfers the contents of the cylinder average table and the percentage difference table, along with the engine rpm value and the overall average value, to the video display circuits 65 in the DIGTXD signal over line 68. This data is processed in the video display circuits 65 in the same manner as was described above in connection with the cylinder burn time bar graph and is transferred to the monitor screen 12 in the VIDEO signal to generate the screen display of FIG. 23. The screen display of FIG. 23 lists the cylinder average values numerically in milliseconds at 102 and lists the percentage difference values numerically at 103 and in bar graph form at 104.

An analysis of the variation of the average cylinder time period for each cylinder from the overall average gives an indication of the variation in power contribution by the several cylinders. For example, if the average cylinder time period figure for a particular cylinder is significantly less than the overall average, it indicates that the engine is running slower during that cylinder time period, which could signify that that cylinder is contributing less power than it should, which might indicate a misfiring. Thus, an effective analysis of cylinder power contribution can be obtained without the need for shorting the cylinders.

Waveform Digital Peak Capture

One problem with a digital oscilloscope is the accurate representation of high frequency waveform signals. The analog waveform is sampled and these discrete sample values are displayed on the screen. Thus, the accuracy of the waveform display will depend on the number of sample values displayed. In a typical oscilloscope screen, there are 512 raster locations across the width of the screen and, therefore, a maximum of 512 sample values can be displayed. If, for example, as is typically the case, a single cylinder time period waveform is to be displayed on the screen, that cylinder time period must be represented with no more than 512 sample values. This is no problem for relatively low frequency portions of the waveform, such as the portions 80*b*–80*d* illustrated in FIG. 14. However, for very high frequency portions of the waveform, such as the spike 80*a*, there can be very large changes in amplitude between two consecutive ones of the 512 displayed samples. If the waveform is sampled at a rate sufficient to produce no more than the 512 samples per cylinder time period, then the peak value of the spike 80*a* may well be missed. Indeed, the entire spike 80*a* may be missed.

The spike can be accurately captured by greatly increasing the sampling rate. But in this case there would be many more than 512 samples per cylinder time period, so that an entire cylinder time period could not be displayed on the screen. In order to solve this problem, the present invention adopts a two-stage sampling process. First of all, the analog waveform is sampled at a first very high rate, sufficient to accurately capture the value of the spike 80*a*, and these very rapid samples are, in turn, sampled at a much slower display sample rate sufficient to display 512 samples per cylinder time period. At the same time, during each cylinder time period a circuit is storing the maximum sample value of the high-frequency samples which occur between two consecutive display sample clock pulses. During low frequency portions of the waveform, when a display sample clock pulse occurs, the system simply selects for display the most recent high-frequency sample. But in a high-frequency portion of the waveform, such as the region of the spike 80*a*, the system will select for display the stored maximum value for that cylinder time period.

The manner in which this is accomplished will be described with reference to FIGS. 8–10, 15 and 16. The microprocessor 145 (FIG. 7) is continuously calculating the engine rpm. It also has a crystal-controlled internal clock which generates 4 MHz clock signals which are applied to the port expander and counter 151 of the display sample clock generator 150 (FIG. 8). The counter of this device is basically a programmable clock, which counts the 4 MHz pulses and outputs a CLOCK pulse once every predetermined number of incoming 4 MHz pulses. This predetermined number is calculated by the microprocessor 145 as the number necessary for the port expander and counter 151 to generate 512 CLOCK pulses during each cylinder time period at the current engine rpm. This calculated number is loaded into the port expander and counter 151 via bus 54. It will be appreciated that this number varies with the engine speed.

Each CLOCK pulse causes the Q output of the flip-flop 152 to go low, which in turn causes the 1Q output of the quad flip-flop 153 to go high, generating the CLKA signal (FIG. 15, waveform A) and causes the −1Q output to go low, generating the CLKA- signal. The CLKA- signal clears the flip-flop 152, causing its Q output to return high. The quad flip-flop 153 is clocked by the 4 MHz clock signal from the microprocessor 145, which has a period of 250 nanoseconds with a 33.3% duty cycle (see FIG. 16, waveform D). Thus, the 1 outputs of the quad flip-flop 153 will change state after 83.3 nanoseconds, at time $t_2$. The CLKA pulse is fed back to the 2D input of the quad flip-flop 153, so that when it goes low at time $t_2$, it will cause the 2Q output to go high, generating CLKB and the −2Q output to go low, generating CLKB-. These pulses will also terminate after 83.3 nanoseconds at time $t_3$. The CLKB signal is fed back to the 3D input, so that at this time the 3Q output will go high generating CLKC and the 3Q− output will go low generating CLKC-, which pulses terminate at $t_4$.

Thus, it can be seen that there is generated a three-phase display sample clock signal, with both positive-going and negative-going versions of each phase, and with the beginning of each phase pulse coinciding with the termination of the preceding phase pulse. Each phase of the sample clock signal has a period P, which is the same as the period of the CLOCK signals from the port expander and counter 151.

Referring to FIG. 10, the analog waveform signal VIN and the reference voltage VREF from the analog circuits are applied to the A/D converter 161, which samples the VIN signal at a 4 MHz sample rate, generating 8-bit digital representations of each sample value and applying them via the bus 162 to the latch 163 and to the P input of the magnitude comparator 164. The value that is stored in the latch 163 appears on the bus 166, which is coupled to the Q input of the magnitude comparator 164. If the latest sample value on the bus 162 is greater than that stored in the latch 163, the P greater than Q output of the comparator 164 goes low and is applied to the D input of the flip-flop 167. The 4 MHz clock pulse which caused the last sample is also applied to the clock input of the flip-flop 167 so that its Q output goes low and its −Q output goes high. The −Q output clocks the latest sample value into the latch 163 replacing the one which had been previously stored there. The new value appears on the bus 166, so that the P and Q inputs of the comparator 164 are now the same and the output returns high. When the Q output of the flip-flop 167 goes low, it causes the output of the OR gate 168 to go low as soon as the 4 MHz clock pulse goes low, which is approximately 83.3 nanoseconds after it went high. The low at the output of the OR gate 168 causes the output of the OR gate 169 to go low, because its other input is also low, thereby returning the flip-flop 167 to a preset condition.

The reason that the other input to the OR gate 169 is low is because, if the engine analyzer 10 is not in a primary, secondary or fuel injection mode of operation, the PEAK signal from the port expander and counter 156 (FIG. 9) will be low, holding the Q output of the flip-flop 170 low. The CLKA- signal is normally high, so that the output of the OR gate 171 will be high, and is inverted at 172.

Thus, with each new sample from the A/D converter 161, the aforementioned comparison takes place and the latest sample value is stored in the latch 163 if it is higher than the previously-stored sample value. As was explained above, the display sample clock pulses are being generated at a much slower rate than the 4 MHz clock pulses. When the next display sample clock signal occurs, CLKA- goes low, causing the output of the OR gate 171 to go low, clearing the flip-flop 167 and causing its −Q output to go high, irrespective of the condition at its D input. Thus, it is just as though the flip-flop 167 had received a 4 MHz clock signal with its D input low. Thus, it will clock the latest sample value into the latch 163 overwriting whatever value was previously captured, whether or not it is higher than that previously captured value. When CLKA- goes low it also causes the new sample value, which now appears on the bus 166, to be written into the FIFO 165.

Thus, in normal operation, whenever the display sample clock signal occurs, the peak value stored in the latch 163 is discarded and, instead, there is written into the FIFO storage circuit 165 the latest sample value from the A/D converter 161, whatever its magnitude. This mode of operation will take place whenever the engine analyzer 10 is not in a primary, secondary or fuel injection mode.

Figure 16:
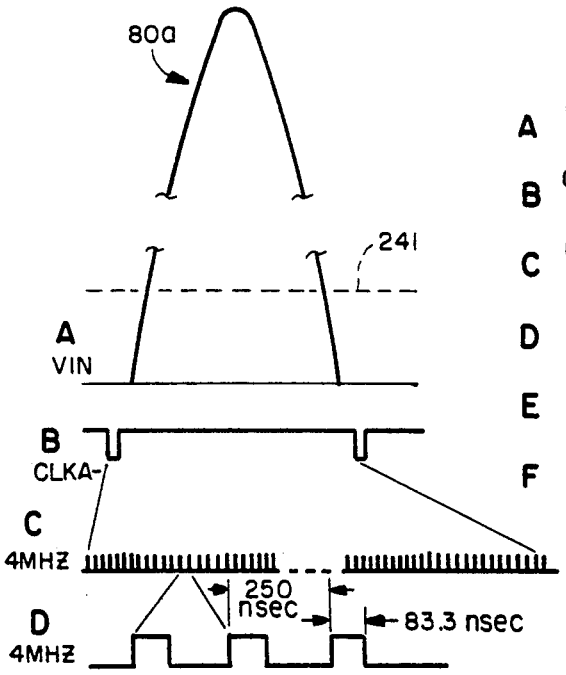
FIG. 16 is a timing diagram illustrating the time relationships among signals in the circuitry of FIG. 10.
Figure 15:
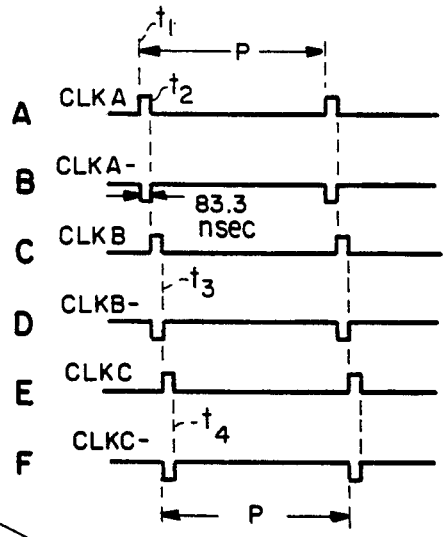
FIG. 15 is a timing diagram illustrating the time relationships of the display sample clock signals generated by the circuitry of FIG. 8.

If the engine analyzer 10 is in one of those three modes, the PEAK signal into the flip-flop 170 will be high, but its Q output will still be low as long as its clock input is low, which is most of the time. However, at a point in time in any of these three modes where the spike portion 80*a* of the signal is occurring, then the peak value of that spike must be captured. When that spike crosses the threshold level 241 (FIG. 14; FIG. 16, waveform A), the ENGSYNC signal applied to the clock input of flip-flop 170 goes high, causing its Q output to go high. The ENGSYNC pulse 242 has a width substantially greater than the period P of the display sample clock. Thus, when CLKA- goes low with the next display sample clock signal, the output of the OR gate 171 stays high because its other input is still high. Thus, it will not clear the flip-flop 167 and will not affect its output. Accordingly, the value that was previously stored in the latch 163 stays there and is not overwritten. Therefore, that previously-stored peak value is written into the FIFO 165. When CLKC- goes low, 166.6 nanoseconds after CLKA- went low, it clears the latch 163 for the next display sample clock period. Thus, since the value in the latch 163 is now zero, the next sample from the A/D converter 161 will be clocked into the latch 163. It can be seen that this mode of operation ensures that the peak value of the spike portion 80*a* of the waveform will be captured and written into the FIFO storage circuit 165. As can be seen in FIG. 16, even though the display sample clock pulse CLKA- missed the peak, the 4 MHz sampling rate of the A/D converter is so great that it is sure to capture the peak value, which will be stored in the latch 163.

The stored peak values are needed for display for only a brief period of time, until just after the spike portion 80*a* of the waveform has passed. Thus, as soon as the ENGSYNC pulse occurs and the Q output of the flip-flop 170 goes high, it causes the counter 175 to start counting the display sample clock pulses CLKA. The preset of the counter 175 is set so that it will count only a predetermined number, preferably 4, of these display sample clock cycles. When the fourth one is counted, the CARRY output of the counter 175 will go low, clearing the flip-flop 170, causing its Q output to return low, and thereby returning the system to normal operation.

The FIFO storage circuit 165 essentially holds 512 samples, enough for a full screen display. Each time a new sample is written into the FIFO storage circuit 165, a previous sample is read out therefrom. The one being read out could be a sample taken anywhere from 1 to 512 display sample clock cycles earlier, as selected by the user. This permits the user to position the waveform on the screen. Normally, the beginning of each cylinder time period would appear at the left-hand edge of the screen, but the user can selectively cause the beginning of the cylinder time period to appear anywhere on the screen. Data representing the selected screen delay is loaded into the port expander and counter 156 (FIG. 9), which counts a predetermined number of the CLOCK pulses (which are occurring at the same rate as the display sample clock) corresponding to that delay. When the predetermined count is reached, the counter outputs a pulse to the clock input of the flip-flop 157, causing its Q output to go low, to produce the SET-OUT signal. Thus, the −Q output of the flip-flop 158 will be toggled by the display sample clock pulses CLKB- and CLKC- to produce the FIFORD signal, which is the read signal for the FIFO storage circuit 165 and is applied thereto through the OR gate 177, the output of which follows the FIFORD signal, since its FREEZE input is normally low. Accordingly, a predetermined screen delay period after a waveform sample is written into the FIFO storage circuit 165, it is read out and sent via the bus 67 to the waveform RAM 149 (FIG. 7) and thence to the video display circuits 65 (FIG. 12).

The displayed waveform signals can be fairly erratic. An operator may wish to look at a certain portion of the waveform or to stop it from updating so that it can be viewed without moving. This can be accomplished by pressing the FREEZE function key 23 on the main keyboard 20. This causes the microprocessor 145 (FIG. 7) to output an FRZST signal to the memory address and control circuit 180 (FIG. 11), which causes the FREEZE signal at the Q output of the flip-flop 198 to go high, which holds the output of the OR gate 177 (FIG. 10) high so that no more read pulses can be applied to the FIFO storage circuit 165. Thus, no new information is being read from the FIFO storage circuit 165 or being sent to the video display circuits 65.

Scanner Interface

When a scanner is coupled to one of the ports A or B of the communication circuits 60, the information read by the scanner from the vehicle on-board computer is passed by the communication circuits 60 to the video display circuits 65, as explained above. In this mode of operation, the scanner controls what is being displayed on the monitor screen 12, and the digital circuits 55 are used only for the purpose of monitoring the soft key set 15 the main keyboard 20.

In this regard, when the particular scanner being used is selected from the scanner menu of FIG. 25, the keys on the main keyboard 20 and in the soft key set 15 will be programmed to perform the functions which are performed by corresponding keys on the scanner. For example, if the scanner contains numerical keys 0 through 9, then the numerical key pad 21 of the engine analyzer 10 will be programmed to perform whatever functions are performed by the corresponding keys on the scanner. This is true of any other keys on the main keyboard, such as the directional keys 22 and function keys 23. Similarly, the scanner may contain a control member such as a thumb wheel for controlling direction, which can be simulated by appropriate programming of the directional keys 22. If the scanner has a key or control member which does not readily correspond to anything on the main keyboard 20, then one or more of the soft keys F1–F6 will be programmed to perform the corresponding function and a scanner screen will be displayed showing those soft key functions.

Whenever a key is pressed, an identifying signal will be sent from the microprocessor 145 (FIG. 7) in the DIGTXD signal on line 68 to the EPLD 211 (FIG. 12), which in turn passes it to the microprocessor 210 in the RXDIN signal. If the key corresponds to a function of the scanner being used, the microprocessor 210 will signal the microprocessor 230 (FIG. 13) via the VIDTXD signal to send this information to the scanner, which will see it as a key depression and respond in the same manner as if the corresponding key on the scanner had been pressed. In this way, the user can operate the scanner from the engine analyzer 10. This may be a significant convenience if the engine analyzer 10 is located at some distance from the scanner, since the user will want to be stationed adjacent to the engine analyzer 10, because the monitor screen 12 is much larger than the display of the scanner and can display much more information at a time.

SOFTWARE

Burn Time Bar Graph

Figure 27A:
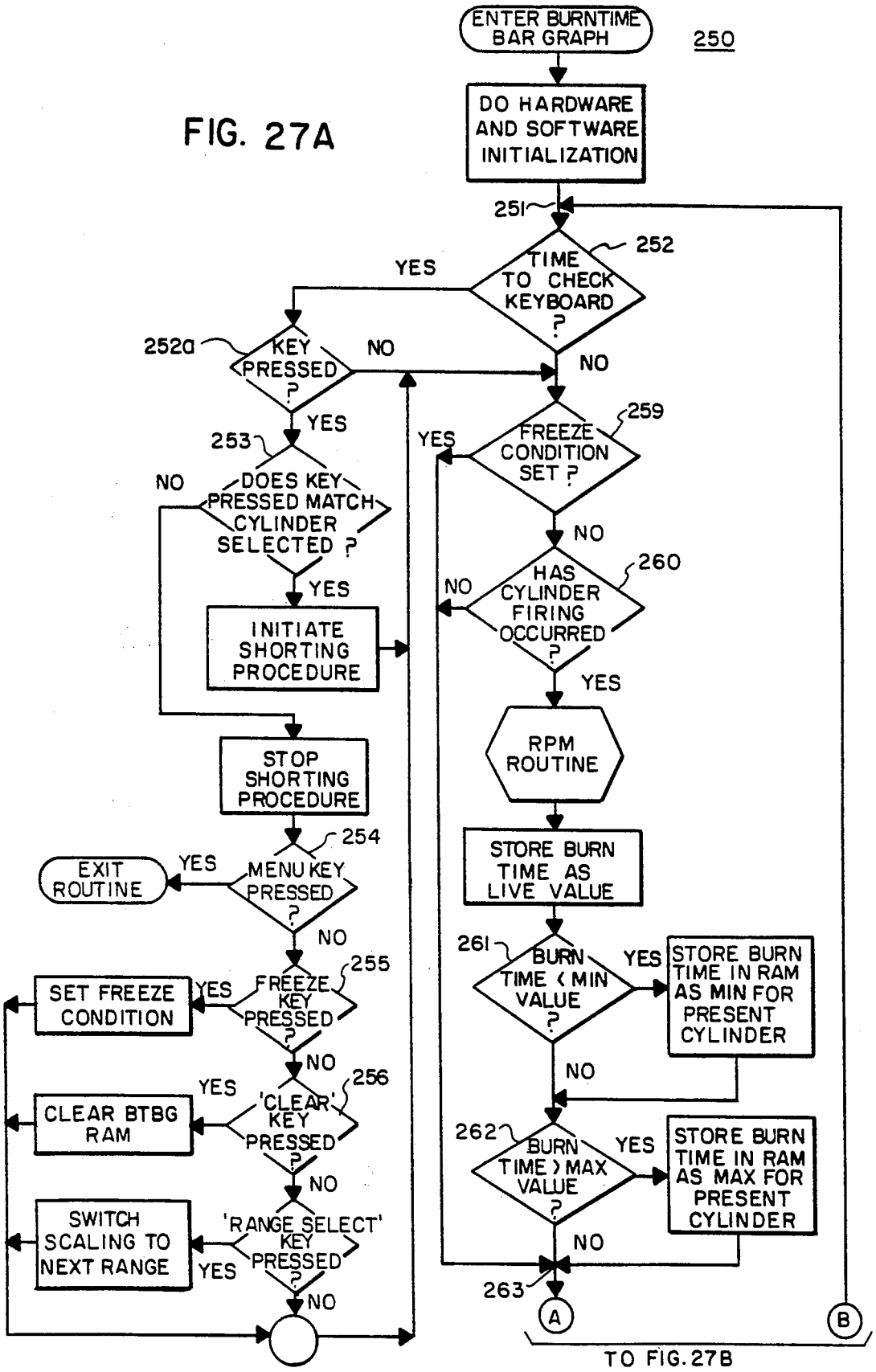
FIGS. 27A–27D are a flow diagram of the spark plug burn time subroutine of the engine analyzer programs, with FIGS. 27C and 27D showing interrupts in the subroutine.
Figure 27B:
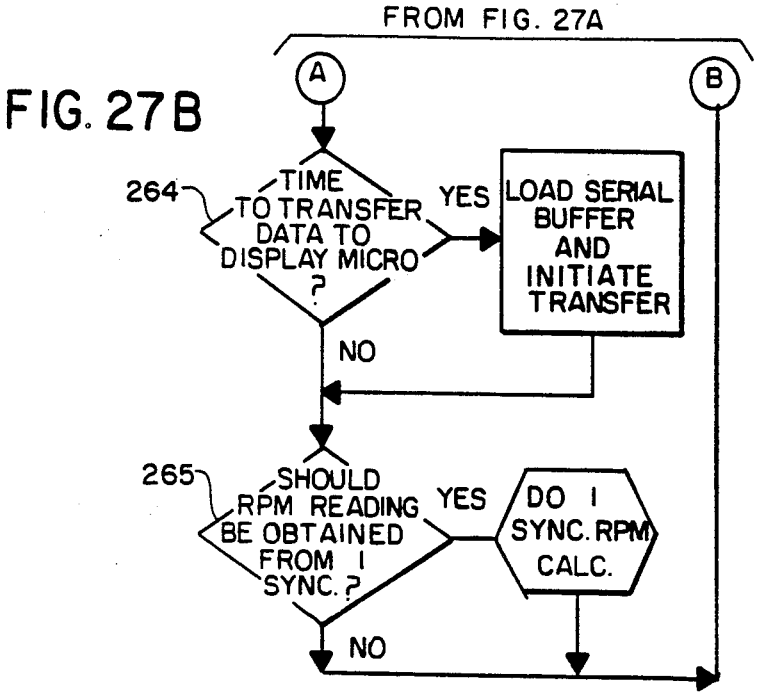

Referring to FIGS. 27A and 27B, there is illustrated a flow chart of the routine 270 of the microprocessor software which controls the spark plug burn time bar graph mode of operation. Upon power up, the program initially performs a hardware and software initialization which starts an internal free-running timer in the microprocessor 145 which will periodically initiate a scan of the main keyboard 20 and the soft key set 15. After initialization, the program proceeds through point 251 to decision 252 and checks to see if it is time to scan the keyboards. If not the program goes to point 258, and if it is time for a scan the program proceeds to decision **252*a* to see if any keys have been actuated since the last scan. If not, the program returns to the main loop at point 258**.

In order to test the operation of the system and the screen display of FIG. 20, the user may selectively short a particular cylinder by pressing the appropriately numbered key on the numeric key pad 21, the cylinder remaining shorted as long as the key is held depressed. When such a cylinder selection key is pressed it will immediately set a cylinder selection flag. Thus, if the decision **252*a* indicates a key has been pressed, the program will next proceed to 253 to see if the key pressed is one of the numeric keys for cylinder selection. If it is, the program initiates a shorting procedure which can be used to simulate a cylinder misfire to test the operation of the system and then returns to point 258; if it does not the program stops the shorting procedure and then checks at decision 254 to see if one of the menu keys 25 has been pressed and, if so, the program exits to another routine appropriate for the selected menu. If the menu key has not been pressed, the program next checks at decision 255 to see if the FREEZE key 23 has been pressed. If it has, the freeze condition is set and the program returns to point 258 and, if it has not, the program continues to decision 256 to check to see if the "Clear" soft key F1 (see FIG. 20) has been pressed. If so, the program clears the portion of the character ram 147 in which the burn time bar graph information is stored and returns to point 258 and, if it has not been pressed, the program continues to check to decision 257 to see if the "Range Select" soft key F2 (FIG. 20) has been pressed. If so, it automatically switches to the next scaling range then returns to point 258 and, if not, the program returns directly to the main program loop at the point 258**.

Figure 27C:
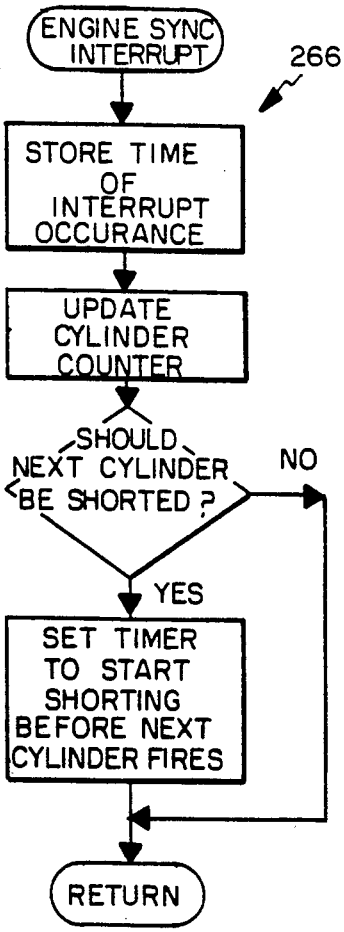

In the event that it was not time for a keyboard scan at decision 252, the program would then proceed through point 258 along the main loop of the program to decision 259 to see if the freeze condition has been set. If it has not, the program checks at decision 260 to see if a cylinder firing has occurred. If it has, the program executes the rpm routine to update the calculation of engine rpm by use of the ENGSYNC signal. When the cylinder firing occurs, it also initiates an engine sync interrupt routine 266 (FIG. 27C) which causes the program to store the time of occurrence of the ENGSYNC signal and increment the software cylinder counter. The interrupt routine then checks to see if the next cylinder should be shorted. If not, it returns to the main loop and if so it sets a timer to start the shorting before the next cylinder fires and then returns to the main program loop.

Figure 27D:
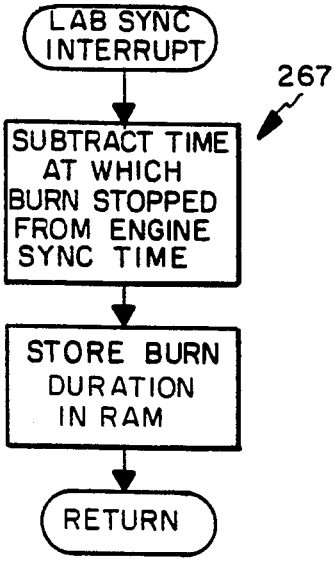

The firing of a cylinder will also result in the generation of the LABSYNC pulse (FIG. 14, waveform D). When the cylinder voltage drops back below the threshold 241, this initiates a LABSYNC interrupt routine 267 (FIG. 27D) in which the program notes the time of occurrence of the LABSYNC interrupt and subtracts from it the time of occurrence of the preceding ENGSYNC interrupt to arrive at the burn time, and then stores this burn time in a temporary register in the character RAM 147 and returns to the main program loop.

After execution of the rpm routine, the main program loop then stores the most recently calculated burn time value in the live value table in the character ram 147 for that particular cylinder and then checks at decision 261 to see if the burn time is less than the value stored in the minimum table. If it is, it stores the new value in the minimum table in place of the previously stored value. The program then next checks at decision 262 to see if the new burn time is greater than the value stored in the maximum table and, if it is, it substitutes the new value for the previously stored value and then proceeds to point 263.

If the freeze condition were set at decision 259, the program would proceed directly to point 263 without checking to see if a cylinder firing had occurred, and would utilize the previously-stored burn time values. Similarly, at decision 260, if a cylinder firing had not occurred since the last cycle through the main program loop, the program would again proceed directly to point 263 to use the previously-stored burn time data.

As was indicated above, the microprocessor 145 periodically transfers data from the burn time tables to a serial buffer area of the character RAM 147 and then transfers it to the video display circuits 65 via line 68 (FIG. 7). From point 263, the burn time bar graph routine proceeds to decision 264 to check to see if it is time to transfer data to the video display circuits 65. If it is, the program transfers the data to the serial buffer portion of the character RAM 147 and initiates a transfer to the video display circuits 65 and then proceeds to decision 265. If it is not time for the transfer the program proceeds directly from decision 264 to decision 265, and there checks to see if an rpm reading should be obtained from the 1SYNC signal. This may be necessary if, for example, the ENGSYNC signal had not been available at the last cylinder firing time. If so, the program performs a 1SYNC rpm calculation and then returns to point 251, and if not the program proceeds directly to 251 to repeat the main loop.

KV Histograph

Figure 28A:
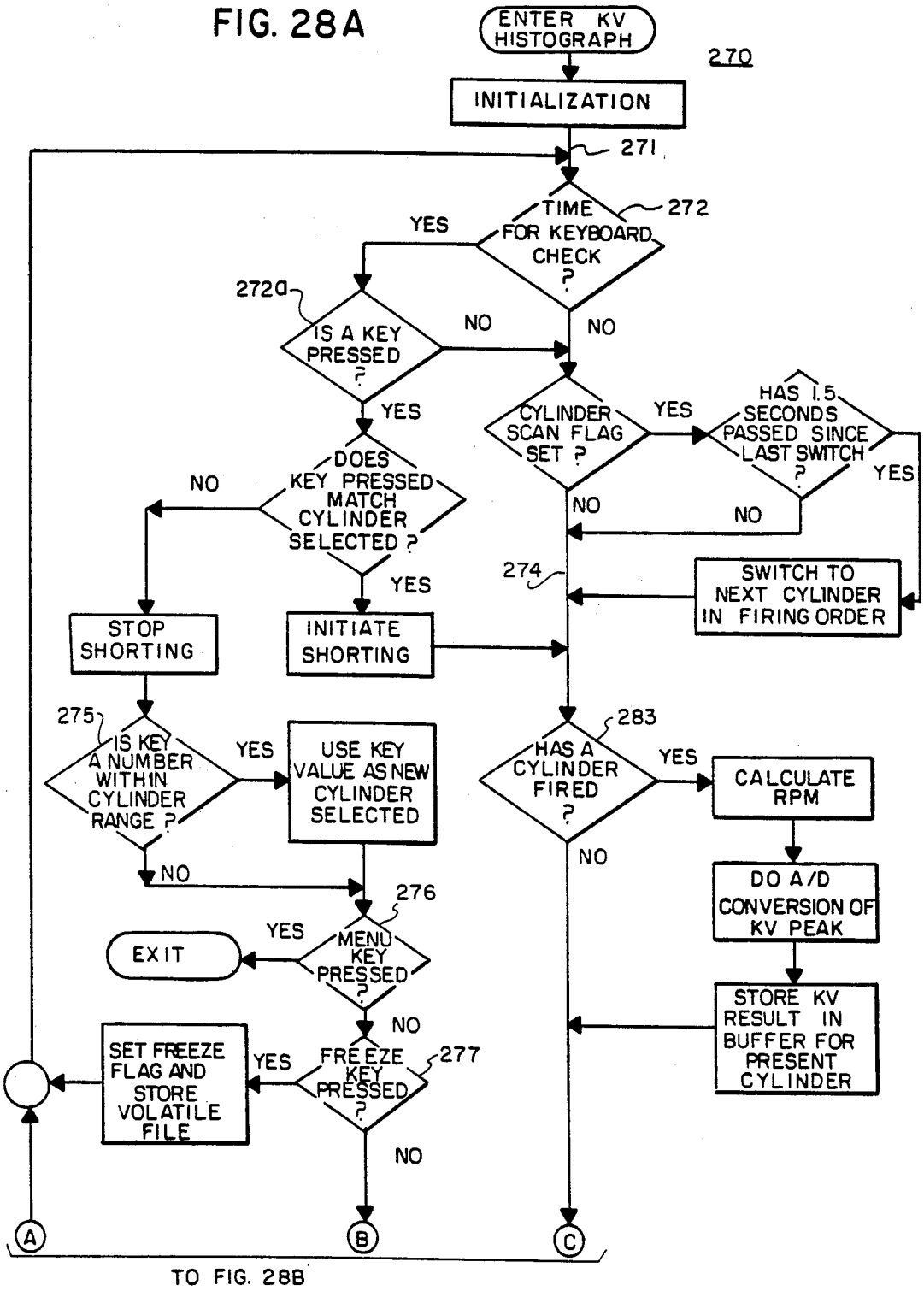
FIGS. 28A and 28B are a flow diagram of the KV histograph subroutine of the engine analyzer programs.
Figure 28B:
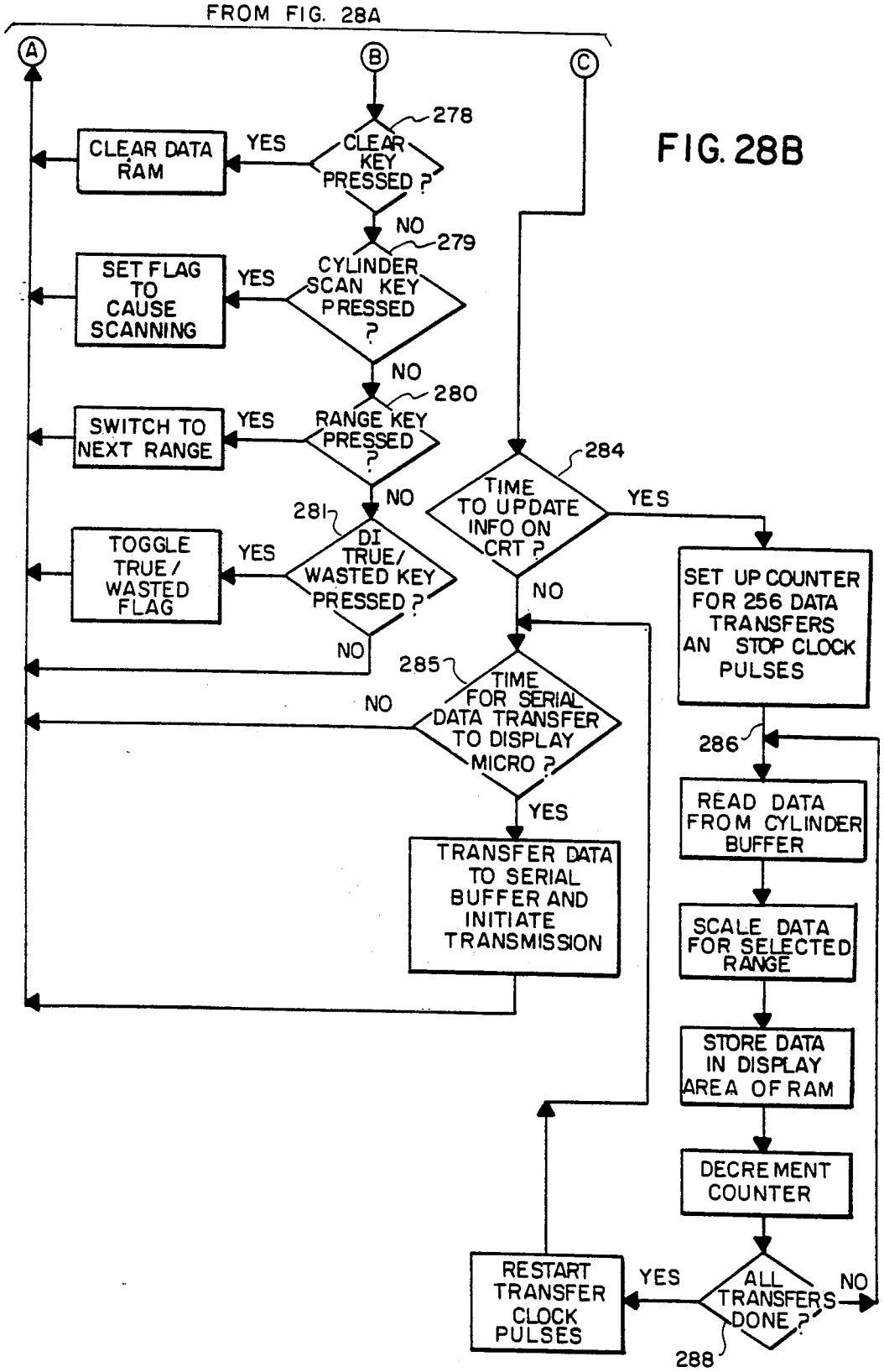

Referring to FIGS. 28A and 28B, there is illustrated the flow chart for the program routine 270 for the KV histograph mode of operation. Upon power up, the program first initializes the hardware and software and then proceeds through point 271 to a decision 272 to check to see if it is time for a keyboard scan. If it is, the program checks at decision **272*a* to see if a key has been pressed. If not the program returns to the main loop at point 272*b* and, if so, the program asks at decision 273 if the key pressed is a cylinder shorting selection key. If it is, the program initiates a shorting routine for purposes of testing the operation of the system and then proceeds to point 274 in the main loop. If it is not, the program stops the shorting routine and checks at decision 275** to see of the pressed key is a number within the cylinder range which has been entered during the setup operation.

If it is, the program uses this entry as a new value of the selected cylinder and proceeds to decision 276. If the key is not a number within the cylinder range, the program proceeds directly to decision 276, where it checks to see if a MENU key 25 has been pressed. If so, the program exits to the appropriate routine for the selected menu and, if not, it proceeds to decision 277 to check to see if the FREEZE key has been pressed. If so, the program sets the freeze flag and stores volatile data and returns to point 271; if not, the program proceeds to decision 278 to see if the "Clear" soft key F1 (FIG. 21) has been pressed. If it has, the program clears the KV histograph data from the character RAM 147 and returns to point 271, and if it has not, the program proceeds to decision 279 to check to see if the pressed key is the "Cylinder Scan" soft key F3 (FIG. 21). If it is, the program sets the flag to cause scanning through the cylinders and returns to point 271 and, if it is not, the program checks at decision 280 to see if the "Range Select" soft key F2 (FIG. 21) has been pressed. If so, the program switches to the next range and returns to point 271 and, if not, the program checks at decision 281 to see if the "True/Wasted" soft key F4 has been pressed (used only in DI applications). If it has, the program toggles the true/wasted flag and returns to point 271, otherwise the program returns directly to 271.

At decision 272, if it were not time for a keyboard check, the program would proceed to decision 282 to see if the cylinder scan flag had been set. If not, the program proceeds to point 274, and if it has, the program checks to see if 1.5 seconds have elapsed since the last cylinder increment during the scan. If not, the program proceeds directly to point 274 and, if it has, the program increments to the next cylinder in the firing order and then returns to point 274. From point 274, the program proceeds to decision 283 to see if a cylinder has been fired. If it has, the program calculates the engine rpm and performs an A/D conversion of the KV peak value of the cylinder voltage and stores the KV value in a buffer in the character RAM 147 for the selected cylinder and then proceeds to decision 284. If the cylinder had not fired at decision 283, the program would proceed directly to decision 284 to check to see if it is time to update the information on the oscilloscope screen. If it is not yet time, the program proceeds to decision 285 to see if it is time for a serial data transfer to the video display circuits 65. If it is not yet time, the program returns to point 271 to repeat the main loop. If it is time, the program transfers the data to the serial buffer portion of the character RAM 147 and then initiates transfer to the video display circuits and then returns to point 271.

At decision 284, if it were time to update the information on the oscilloscope, the program would set up a counter for 256 data transfers, i.e., a transfer from the character RAM 147 of the KV values for 256 consecutive firings of the selected cylinder, and would stop the clock pulses for the transfer times. The program would then proceed through point 286 to read the data from the cylinder buffer, scale the data for the selected range and store the data in the display area of the waveform RAM 149, then decrement a transfer counter and check at decision 288 to see if all the transfers are completed. If not, the program returns to point 286 to read out another KV value and then continues repeating this loop until all 256 data transfers are completed. The program will then restart the transfer clock pulses and proceed to decision 285 to see if it is time for transfer of data to the video display circuits 65.

Cylinder Time Balance Bar Graph

Figure 29B:
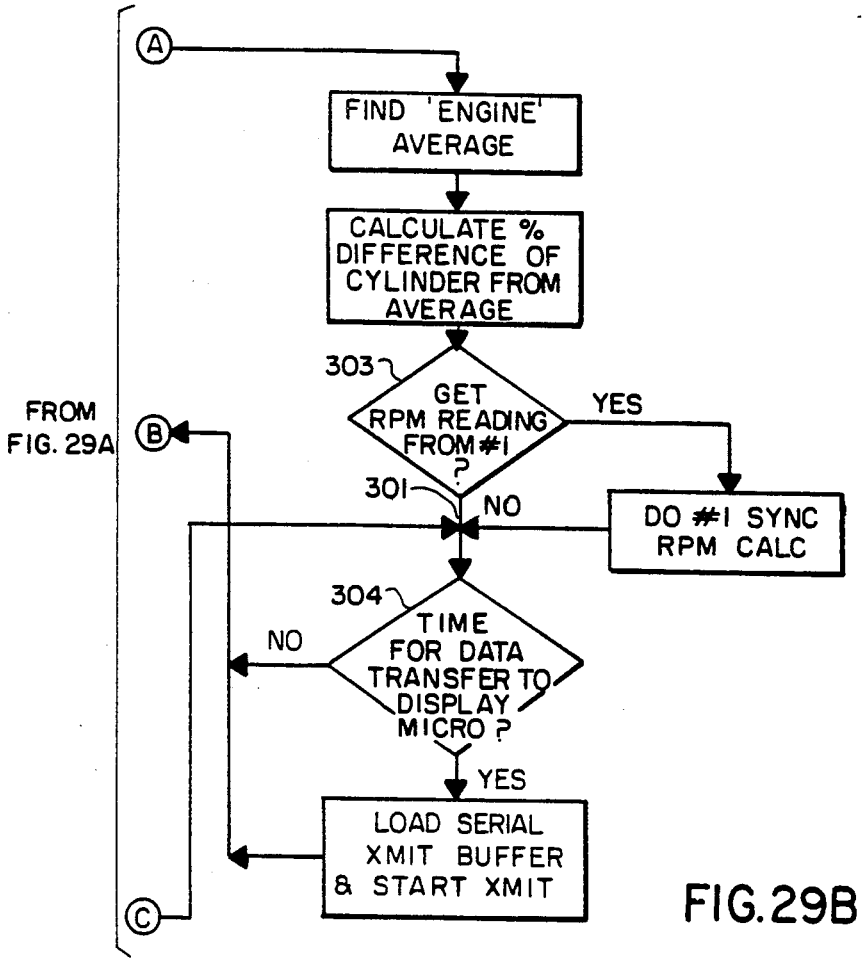
Figure 29C:
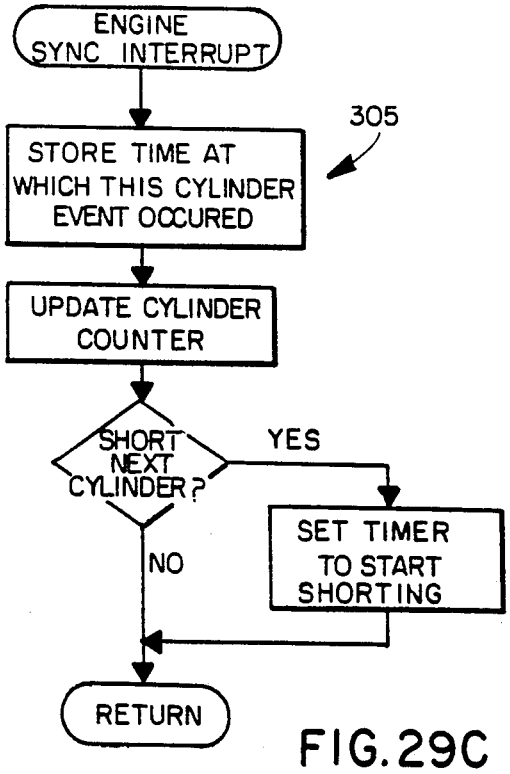

Referring to FIGS. 29A–C, there is illustrated a flow chart of the program routine 290 for operating the engine analyzer 10 in the cylinder time balance bar graph mode. On start-up, the program first initializes the hardware and software and then, based upon the information entered for the particular engine under test during setup, selects the appropriate one of three cylinder ranges, viz., range 1 if the number of cylinders is greater than seven, range 2 if the number of cylinders is greater than four and less than eight, and range 3 if the number of cylinders is less than five. This selection will determine the number of cylinders which appear on the bar graph screen display of FIG. 23.

The program then passes through point 291 to decision 292 to determine if it is time to check the keyboard. If it is not, the program proceeds to point 293 and, if it is, the program first checks at decision **292*a* to see if a key has been pressed. If not, the program returns to the main loop at point 293 and, if so, the program then checks at decision 294 to see if the key is a cylinder shorting selection. If it is, the program initiates the shorting routine and then returns to point 293. If not, the program disables the shorting routine and next checks at decision at 295 to see if the "Clear" soft key F1 (FIG. 23) has been pressed. If it has, the program clears the cylinder time balance bar graph table in the character RAM 147 and returns to point 293. If the "Clear" key has not been pressed, the program next checks at decision 296 to see if the "Range Select" soft key F2 (FIG. 23) has been pressed. If so, the program switches to the next one of the cylinder ranges, cycling through the ranges in numerical order, and then returns to point 293**.

If the "Range Select" key has not been pressed, the program next checks at decision 297 to see if any one of the MENU keys 25 has been pressed. If so, the program exits to the appropriate menu routine, and if not, proceeds to check at decision 298 to see if a cylinder select key has been pressed. In this mode of operation, the up and down arrow keys 22 may serve as cylinder select keys in that, if one of these keys is pressed, the program will scroll in the indicated direction through the cylinder firing order and will stop when the key is released, the program then returning to point 293. If a cylinder select key has not been pressed, the program next checks at decision 299 to see if the FREEZE key 23 has been pressed. If so, it sets the freeze condition and then returns to point 293 and, if not, it proceeds directly to point 293.

From point 293, the program proceeds in the main loop to decision 300 to see if the freeze condition has been set. If it has, the program proceeds directly to point 301 and, if it has not, the program first goes to decision 302 to see if a cylinder firing has occurred and, if not, then proceeds to point 301. If a cylinder firing has occurred at decision 302, the program performs the rpm calculation routine in order to calculate the cylinder time period duration, i.e., the time between the most recent firing and the immediately preceding one, and then stores that duration in a table for the appropriate cylinder in the character RAM 147. This table stores 10 values for that cylinder, i.e., the cylinder time period values for the last ten firings of that cylinder. If the table is already full, the new value is substituted for the oldest one in the table.

The program then adds all the samples in that cylinder table and divides by the number of samples stored to obtain the cylinder average value and stores it in an appropriate table. The program then adds the cylinder average values for all the cylinders and calculates the overall engine average and stores that value, then calculates the percentage difference between the cylinder average for the particular cylinder and the overall engine average and then proceeds to decision 303 to see if 1SYNC signal has occurred. If so, the program updates the 1SYNC engine rpm calculation and proceeds to point 301 and, if not, the program goes directly to 301, from which it proceeds to decision 304 to see if it is time for a data transfer to the video display circuits 65. If it is not time, the program returns to point 291 to repeat the main loop, and if it is time for a transfer, the program shifts the cylinder time period data from the tables of the character RAM 147 to the serial buffer portion thereof, and then begins transferring the data to the video display circuits via the line 68, and then returns to point 291.

Each time a cylinder is fired, producing the ENGSYNC signal, the program enters the engine sync interrupt subroutine 305 (FIG. 29C) and stores the time at which the cylinder firing occurred. It then increments the software cylinder counter and checks to see if the next cylinder is to be shorted. If so, the program first sets the timer to start the shorting process and returns to the main loop, otherwise it returns directly to the main loop.

Scanner Interface

Figure 30:
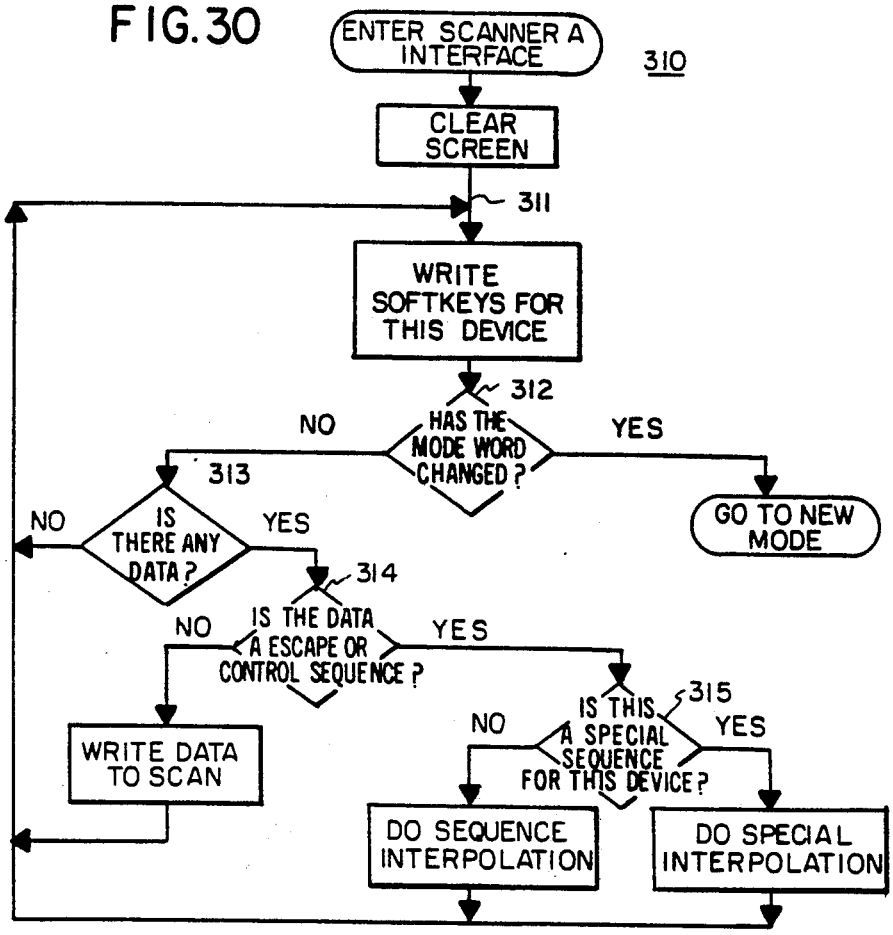
FIG. 30 is a flow diagram of a scanner interface subroutine of the engine analyzer programs.

Referring to FIG. 30, there is illustrated a flow chart of the program routine 310 for operating the scanner interface mode. The flow chart shows the routine for a particular scanner A, for purposes of illustration, but it will be appreciated that similar subroutines are provided for each of the other scanners which may be selected from the scanner menu screen display 25. Initially, upon selection of a scanner, the program clears the screen and then proceeds through point 311 to write the soft key labels for this particular scanner, and then checks at decision 312 to see if one of the menu keys 25 has been pressed. If it has, the program exits to the selected mode and, if it has not, the program proceeds to decision 315 to see if any data is being transmitted from the scanner to the engine analyzer 10 or from the engine analyzer 10 to the scanner. If there is no data present, the program returns to point 311, and if there is data, the program proceeds to decision 314 to see if the data is an ESCAPE or other control sequence. If it is not, the program assumes that it is substantive data and writes it to the screen, and then returns to point 311. If the data is an escape or control sequence, it is data sent by the scanner for screen control. In this case, the program proceeds to decision 315, to check to see if this particular control sequence has any special significance for this scanner. If it does not, the program does a standard sequence interpretation and returns to point 311. If it is a sequence which has special meaning for the scanner, the program performs a special interpretation before returning to point 311.

Figure 31:
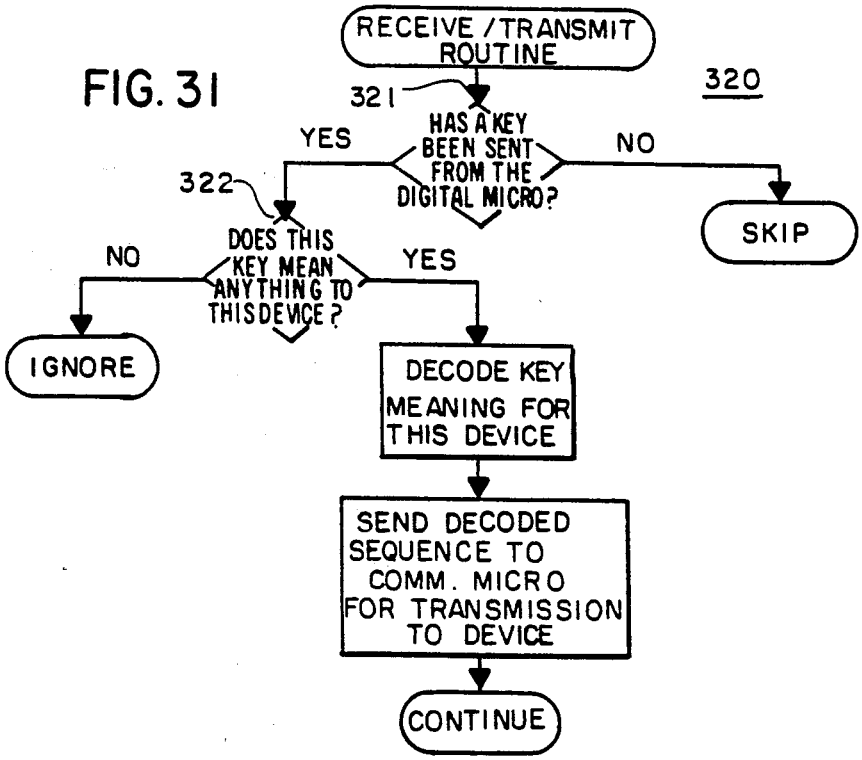
FIG. 31 is a flow diagram of the portion of the receive/transmit subroutine of the engine analyzer programs which is pertinent to the scanner interface subroutine of FIG. 30.

Referring to FIG. 31, there is illustrated a flow chart for a portion 320 of the receive/transmit routine which is pertinent to the scanner interface. In this routine the program checks at decision 321 to see if a key on the engine analyzer 10 has been pressed. If it has not, the program skips this portion of the subroutine and continues in a main loop (not shown) of the receive/transmit routine. If a key has been pressed, the program checks at decision 322 to see if this key has any significance for this particular scanner. If not, the program skips the balance of the routine and continues in the main loop of the receive/transmit routine. If the key does have special significance for the scanner, the program decodes the key meaning for this particular scanner and then sends the decoded sequences to the communication circuits 60 for transmission to the scanner.

From the foregoing, it can be seen that there has been provided an improved digital engine analyzer which permits ready comparison of the burn times of the several engine cylinders by means of a burn time bar graph, deriving the burn time information from a single analog input signal; provides a historical display of peak ignition voltage values for a selected cylinder over a number of engine cycles in a running graphical display; provides a relatively stable display of cylinder time balance information; permits substantially accurate presentation of portions of an analog waveform having very short rise and fall times while at the same time permitting an entire cylinder period of the waveform to be displayed on the screen, and permits an interface with a scanner which allows the scanner control functions to be effected from the engine analyzer keyboard.

We claim:

1. In a vehicle diagnostic system including display means remote from the vehicle and having a display screen, sensing means for monitoring one or more vehicle parameters and generating parameter data signals, and a hand-held controller adapted to be coupled to the sensing means for gaining access to the parameter data signals, said controller having first control members selectively operable for causing the controller to perform control functions for controlling the flow of parameter data signals from the sensing means to the controller when the controller is coupled to the sensing means, the improvement comprising: coupling means for coupling the controller to the display means for transferring parameter data signals from the controller to the display means, second control members adjacent to the display means, and processing means operating under stored program control and coupled to said second control members and to the display means and to the hand-held controller for controlling information displayed on the display means in response to actuation of said second control members, said processing means including means for causing operation of predetermined ones of said second control members to duplicate the control functions performed by operation of predetermined ones of the first control members and to apply corresponding control signals to said coupling means for transfer to the controller, whereby operation of the hand-held controller and the display means can be effected from adjacent to the display means by operation of said second control members without operation of the first control members.

2. The system of claim 1, wherein the vehicle includes an internal combustion engine, and the sensing means monitors engine parameters.

3. The system of claim 2, and further comprising an engine analyzer console including the display means.

4. The system of claim 1, wherein said processing means includes means selectively operable for causing operation of predetermined ones of said second control members to duplicate the control functions performed by operation of predetermined ones of the first control members on a selected one of a plurality of different hand-held controllers.

5. The system of claim 1, wherein said second control members include keys of a keyboard.

6. The system of claim 1, wherein said second control members include soft keys disposed adjacent to the display screen and having the functions thereof identified by indicia displayed on the display screen respectively adjacent to the keys.

7. The system of claim 1, wherein said processing means includes means for controlling the information displayed on the display screen in response to actuation of the first control members.

8. The system of claim 1, wherein the display means is a cathode-ray tube monitor.

9. The system of claim 8, wherein the display means is a digital oscilloscope.

* * * * *